US007424856B2

(12) United States Patent
Brennwald et al.

(10) Patent No.: US 7,424,856 B2
(45) Date of Patent: Sep. 16, 2008

(54) GRATE ELEMENT FOR A GRATE OF A WASTE COMBUSTION INSTALLATION

(75) Inventors: Werner Brennwald, Neftenbach (CH); Manfred Wider, Uster (CH); Fritz Weber, Netstal (CH)

(73) Assignee: Von Roll Umwelttechnik AG (CH)

( * ) Notice: Subject to any disclaimer, the term of this patent is extended or adjusted under 35 U.S.C. 154(b) by 397 days.

(21) Appl. No.: 10/525,565

(22) PCT Filed: Aug. 22, 2003

(86) PCT No.: PCT/EP03/09323

§ 371 (c)(1),
(2), (4) Date: Feb. 25, 2005

(87) PCT Pub. No.: WO2004/025181

PCT Pub. Date: Mar. 25, 2004

(65) Prior Publication Data

US 2005/0257723 A1 Nov. 24, 2005

(30) Foreign Application Priority Data

Aug. 29, 2002 (EP) ..... 02405738

(51) Int. Cl.
*F23H 7/08* (2006.01)

(52) U.S. Cl. ..... 110/281; 110/258; 110/291

(58) Field of Classification Search ..... 110/281, 110/257, 258, 267, 268, 282, 283, 284, 289, 110/290, 291, 296

See application file for complete search history.

(56) References Cited

U.S. PATENT DOCUMENTS

| | | | | |
|---|---|---|---|---|
| 4,170,183 | A | 10/1979 | Cross | |
| 4,901,653 | A * | 2/1990 | Baltzinger | 110/281 |
| 5,197,397 | A | 3/1993 | Yamagishi et al. | |

FOREIGN PATENT DOCUMENTS

| | | |
|---|---|---|
| CH | 585 372 | 2/1977 |
| DE | 525 221 | 5/1931 |
| DE | 1 099 117 | 2/1961 |
| EP | 1 001 218 B1 | 5/2000 |
| FR | 2 265 041 | 10/1975 |

OTHER PUBLICATIONS

Max Künzli, W + E-Gegenlauf Überschubrost, p. 1-17.

* cited by examiner

*Primary Examiner*—Kenneth B Rinehart
(74) *Attorney, Agent, or Firm*—Hershkovitz & Associates, LLC; Abe Hershkovitz

(57) ABSTRACT

The present invention relates to a grate element (1) for a grate of a waste-incineration plant, having a plurality of rows of grate blocks, which are moveable or fixed, arranged one behind the other, a plurality of grate blocks (67) being arranged in each row of grate blocks. A first number of grate blocks arranged in a moveable row of grate blocks here is assigned to a first grate carriage (5), and a second number of grate blocks arranged in a moveable row of grate blocks is assigned to a second grate carriage (35), it being possible for the first number of grate blocks to be moved independently of the second number of grate blocks.

3 Claims, 7 Drawing Sheets

FIG.4
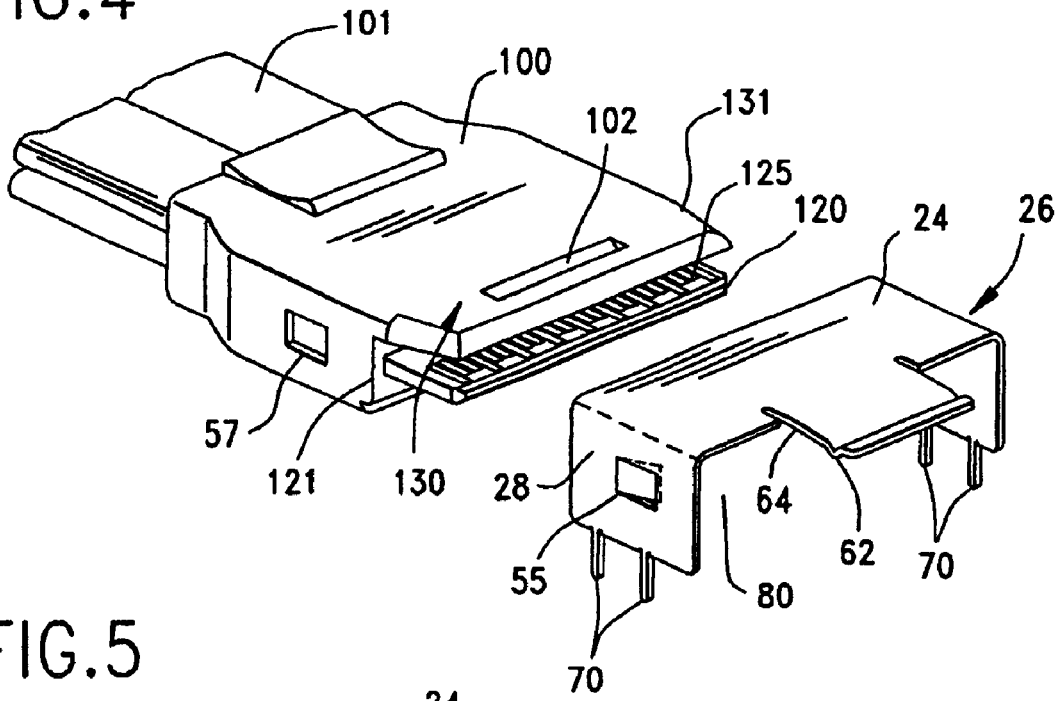
FIG.5
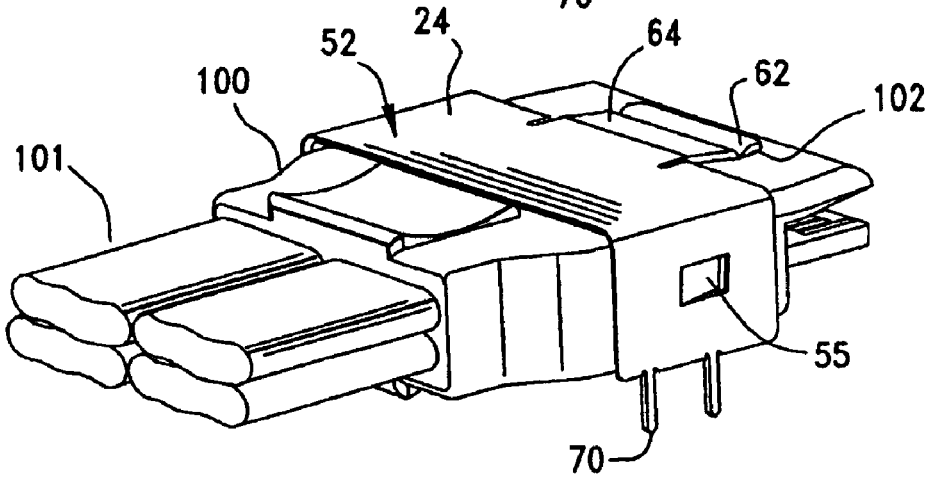
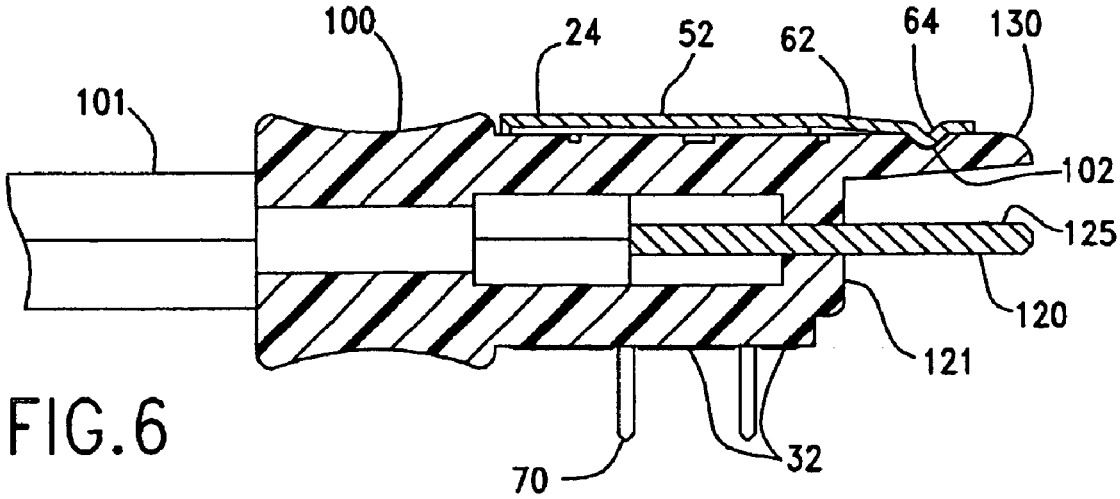
FIG.6

GRATE ELEMENT FOR A GRATE OF A WASTE COMBUSTION INSTALLATION

The invention relates to a grate element for a grate of a waste-incineration plant, having a plurality of rows of grate blocks arranged one behind the other.

Conventional inclined forward-feed grates for waste-incineration plants have grate elements having a plurality of rows of grate blocks arranged one behind the other, a moveable row of grate blocks being followed by a fixed row of grate blocks. The moveable rows of grate blocks are assigned to a grate carriage, by means of which they are moved forward and back (CH 585 372). The intermixing and the raking of the waste here take place in the transporting direction.

The prior art also discloses a backward-feed grate, which is described in a large number of patents, for example in DE 525221 and DE 1099117. Such a backward-feed grate is an inclined grate having alternately fixed and moveable rows of grate blocks. By virtue of the grate blocks of the moveable rows of grate blocks, the bottom layers of the waste which is to be incinerated are pushed in the direction of the start of the grate, the top layers moving in the direction of the end of the grate. The waste is thus pushed away counter to the transporting direction, with the result that the waste is piled up at the start of the grate and conveyed downward by the gravitational force, this taking place, in part, by way of an uncontrolled slipping action.

A further grate system which is well-known to the person skilled in the art is constituted by the W+E combustion grates, which are described, for example, in M. Kütnzli, Rostfeuerungen zur Abfallverbrennung [grate furnaces for waste incineration], Dieter O. Reimann (Ed.), Berlin: EF-Verlag für Energie und Umwelttechnik, 1991, pages 1-17. Oppositely directed movement of moveable rows of grate blocks here, which are arranged alternately with fixed rows of grate blocks, results not just in the waste which is to be incinerated being pushed forward, but also in it being continuously raked and circulated.

EP 1 001 218 describes a water-cooled combustion grate which comprises a combination of a forward-feed grate and of a backward-feed grate, both having water-cooled grate plates, of which at least every second one is of moveable configuration.

U.S. Pat. No. 4,170,183 and FR 2 265 041 describe so-called longitudinal grates of a waste-incineration plant. A longitudinal grate is understood as being a grate which, in the transverse direction, i.e. transversely to the transporting direction, has a plurality of moveable and fixed longitudinal tracks extending over the entire length of the grate. A longitudinal track here has a plurality of grate blocks arranged one behind the other. Each fixed longitudinal track is followed by a moveable longitudinal track. The longitudinal grates described have a plurality of bars which allow the movement of the longitudinal tracks in the transporting direction. The longitudinal grate is purely a conveying subassembly and allows only uncontrolled transportation of the waste. Since the movement of the longitudinal tracks takes place over the entire length of the grate, the transporting speed and thus the operating conditions cannot be regulated independently in each incineration zone.

A stepped grate is made up, in the transporting direction, of a plurality of grate elements, usually three to six grate elements being arranged one behind the other. A stepped grate may comprise one to five grate tracks.

Each grate element has a plurality of rows of grate blocks arranged one behind the other in a step-like manner in the transporting direction, the rows of grate blocks being fixed or moveable. That is to say, in the case of the stepped grate with fixed and moveable rows of grate blocks, in contrast to the longitudinal grate, it is the rows of grate blocks, and not longitudinal tracks, which are moveable in each case. A row of grate blocks is formed in each case by a plurality of, for example 16 to 30, grate blocks. The grate blocks may be water- or air-cooled. The grate blocks are fitted one beside the other on a block-holding tube and braced together by means of a tie rod. Each grate block has a foot which rests on the surface of the following grate block, as seen in the transporting direction. In the case of a forward movement, the foot of the upper grate block thus passes over the surface of the grate block therebeneath in the transporting direction.

The object of the present invention is to provide a grate element in the case of which the waste is mixed intensively and continuously and conveying takes place in a controlled manner.

The object is achieved by the grate element having the features of patent claim 1. Further advantageous embodiments are claimed in the dependent claims and outlined in the description.

According to the invention, a first number of grate blocks of a moveable row of grate blocks is assigned to a first grate carriage and a second number of grate blocks is assigned to a second grate carriage, the grate element according to the invention being equipped with two grate carriages. Dividing the grate blocks of a row or grate blocks between two different grate carriages causes the movement capability of the first number of grate blocks to be independent of the movement capability of the second number of grate blocks. This results in some of the grate blocks moving rearward, while the rest of the grate blocks move forward. The independent movement capability of the grate blocks gives rise to additional lateral intermixing. Peaks and troughs of waste are thus produced on the grate and are moved forward and back in an alternating manner. This results in the waste being mixed and raked both laterally and in the transporting direction. By virtue of the extremely good intermixing and conveying of the waste, the incineration sequence can be better controlled since fewer deflagrations occur. Moreover, by virtue of the continuous circulation, the waste only remains lying in the same location for a short period of time, which results in the grate blocks being subjected to less thermal stressing. The grate element according to the invention is thus less susceptible to malfunctioning, has a long service life and guarantees cost-effective operation.

Since the first number of grate blocks can be moved independently of the second number of grate blocks, different types of operation are possible. It is thus possible to adjust the movement pattern of the grate element in different ways depending on the type of waste. Dividing the individual grate blocks widthwise in relation to the corresponding grate carriages advantageously takes place in groups of five or seven grate blocks. It would also be conceivable, however, for division to take place with a larger or smaller number of blocks or an even number of blocks.

The surface area of the waste which is to be incinerated is increased by the optimum circulation. The incineration process thus takes place more quickly and completely.

The grate element according to the invention is thus cost-effective and very advantageous from an ecological standpoint.

The first grate carriage and the second grate carriage advantageously have a guide arrangement with interacting guide elements. The guide elements ensure that the two grate carriages move on the tracks envisaged for them and do not move apart from one another in space. Such guide elements may be, for example, guide grooves and guide noses, although other guide elements known to the person skilled in the art are also conceivable.

In a preferred embodiment, the first grate carriage and the second grate carriage have drive arrangements which are independent of one another. It is also possible, however, for the first grate carriage and the second grate carriage to have mechanically coupled, opposite directed drive arrangements. Preferred drive arrangements are hydraulic, pneumatic or electric actuating drives. A cylinder/piston subassembly is particularly preferred here. The independent drive arrangements allow the two grate carriages to be controlled individually. It is also possible for the first grate carriage to have two drive arrangements and for the second grate carriage to have one drive arrangement. On the one hand, this makes it possible for the first grate carriage (primary carriage) to require smaller drive arrangements, which allow straightforward and quick exchange during operation. On the other hand, by virtue of the drive arrangements being provided laterally and centrally on the first and the second grate carriages, the forces to which the grate element is subjected are distributed uniformly.

In a preferred embodiment, the first grate carriage and the second grate carriage are moved cyclically in counter-phase. This means that, when the first grate carriage executes a forward movement, the second grate carriage executes a rearward movement. In a further preferred embodiment, the first grate carriage and the second grate carriage are moved cyclically in phase, which means that the first grate carriage and the second grate carriage are moved simultaneously over different movement sections.

It is preferably the case that, within the same row of grate blocks, one to seven, particularly preferably three to five, grate blocks located directly one beside the other, and together constituting a group of grate blocks, have the same movement direction, i.e. they are assigned to the same grate carriage. This achieves an optimum intermixing effect.

In the case of the grate element according to the invention, in each case one fixed row of grate blocks is followed in the transporting direction by a moveable row of grate blocks. However, it is also possible for a plurality of moveable rows of grate blocks to follow directly one after the other. Such an embodiment is preferably selected when very intensive intermixing is necessary.

A grate of a waste-incineration plant preferably has at least one grate element according to the invention. A further preferred variant is for all the grate elements to be grate elements according to the invention.

The invention will now be explained in more detail with reference to the drawings. Equivalent parts are provided with the same designations.

Figure 1:
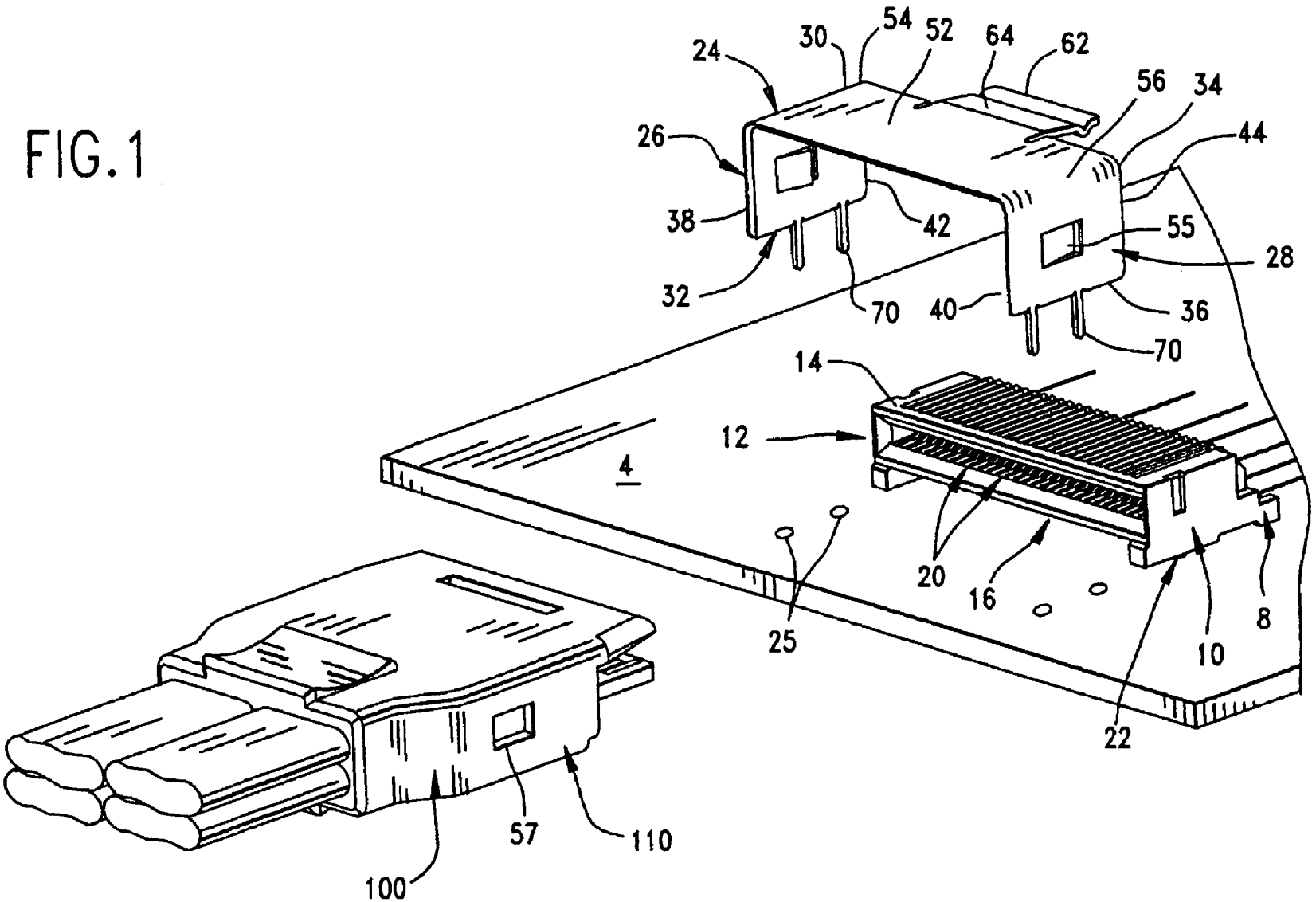
FIG. 1 shows an exemplary embodiment of a first grate carriage.

FIG. 1 shows a first grate carriage 5. The grate carriage has two parallel first longitudinal members 9 with a hollow profile and first crossmembers 11, which are arranged at right angles thereto and have a U profile which is open in the downward direction. The crossbars 11 are intended for bearing brackets with block-holding-tube portions for a first number of grate blocks of the moveable rows of grate blocks. The first crossmembers 11 are preferably arranged at equal distances from one another. The first grate carriage 5 is moved forward and back, via rollers 15, on running surfaces 17 of a rail element 19. The end position of the cylinders 27 constitutes at the same time the rear stop and the front stop, and thus defines the end position of the grate carriage 5. The first grate carriage is driven by means of a cylinder/piston subassembly 25. A piston 29 is located within the cylinder 27. The first longitudinal member 9 is connected, via an articulation 33, to a piston rod 31 which, in turn, is connected to the piston 29. Two guide elements, each in the form of a guide groove 23, are located on the two inner walls of the two first longitudinal members 9. The guide grooves 23 are intended for interacting with four guide noses of a second grate carriage. The first grate carriage 5 is intended for moving a first number of moveable grate blocks.

Figure 2:
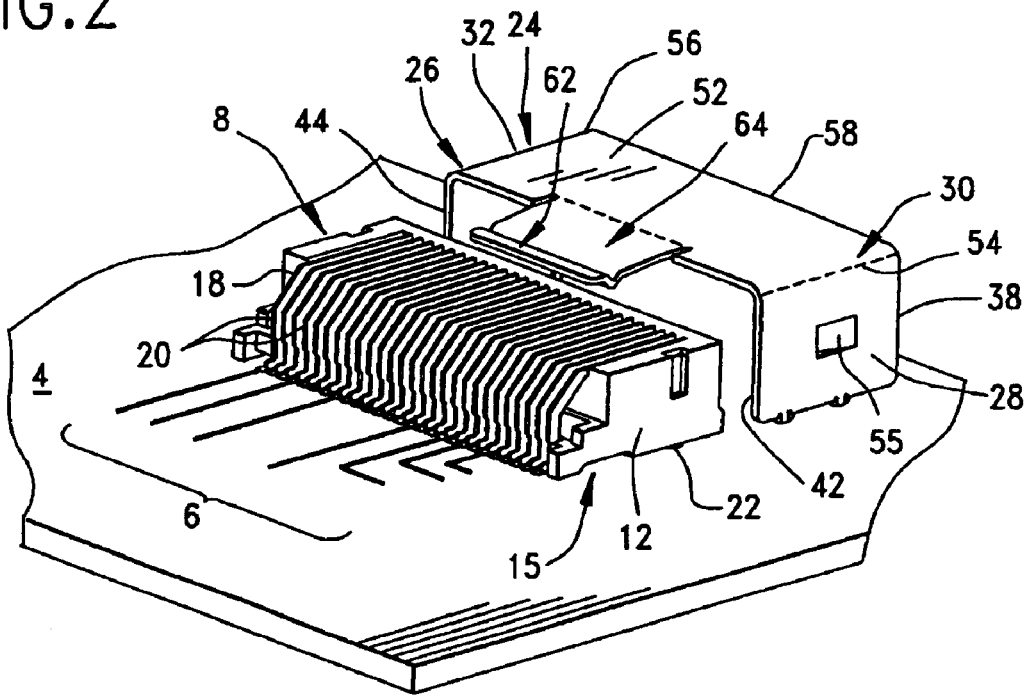
FIG. 2 shows an exemplary embodiment of a second grate carriage.

FIG. 2 shows the second grate carriage 35 with two parallel second longitudinal members 37, with an L profile, running in the transporting direction. Located between the second longitudinal members 37 are two crossmembers 39 with a U profile which is open in the downward direction, these being intended for bearing brackets with block-holding tubes for a second number of grate blocks of the moveable rows of grate blocks. The second crossmembers 39 are preferably arranged at equal distances from one another. The second grate carriage 35, moreover, has two guide elements, each in the form of a guide nose 41, on the outer surface of the second longitudinal members 37, these guide elements being intended for interacting with the four guide grooves 23 of the first grate carriage 5. The second grate carriage 35 is driven by means of a second cylinder/piston subassembly 43. The cylinder 27 is coupled, via a piston rod 31, to a third longitudinal member 45, with a rectangular hollow profile, which is connected to the second crossmembers 39. The crossmembers here have U-shaped recesses 47, in which the third longitudinal member 45 is arranged.

Figure 3:
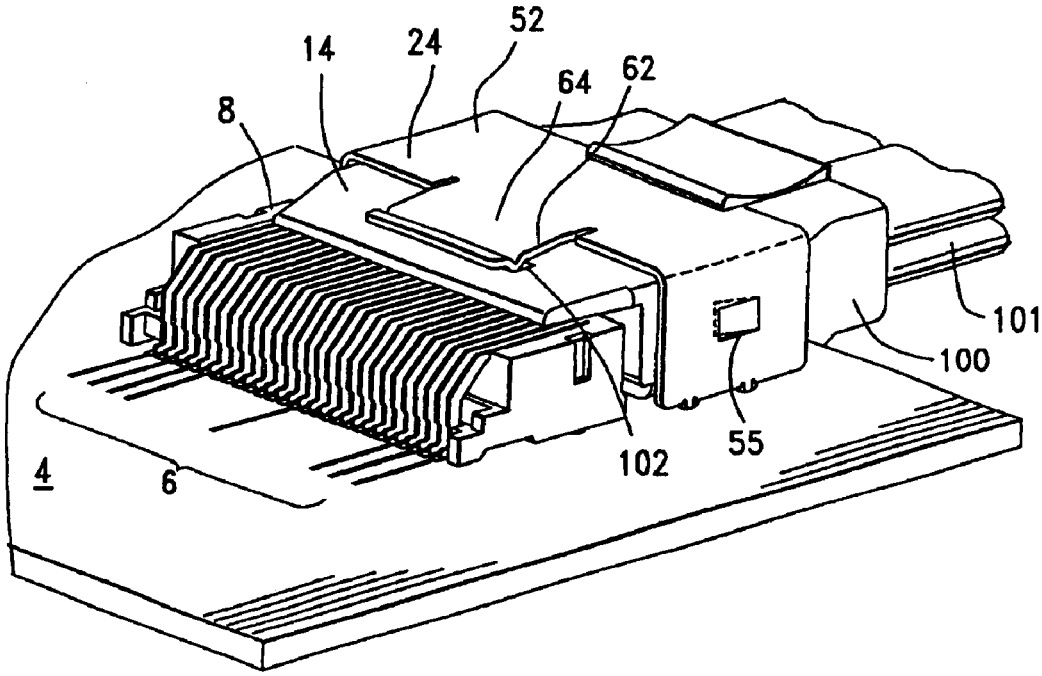
FIG. 3 shows the grate carriages shown in FIGS. 1 and 2, together.

FIG. 3 shows the first grate carriage 5 and the second grate carriage 35. The four guide grooves 23 of the first grate carriage 5 interact with the guide noses 41 of the second grate carriage 35. The first crossmembers 11 are arranged alternately with the second crossmembers 39 of the second grate carriage 35. However, it would also be conceivable for a plurality of crossmembers of the same grate carriage to follow directly one after the other. The first cylinder/piston subassembly 25 of the first grate carriage 5 [lacuna] is independent of the second cylinder/piston subassembly 43.

Figure 4:
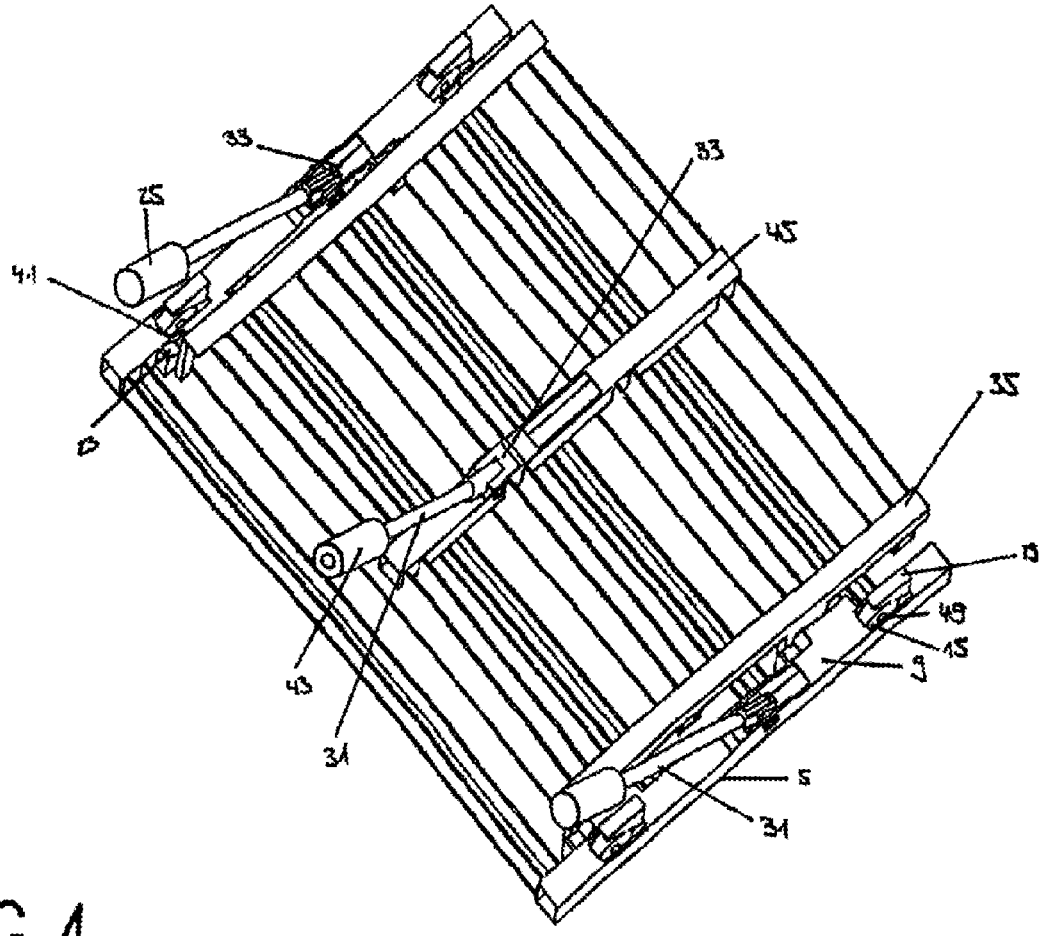
FIG. 4 shows the bottom view of the grate carriages shown in FIG. 3.

FIG. 4 shows the first grate carriage 5 and the second grate carriage 35 from beneath. The two first longitudinal members 9 of the first grate carriage 5 have, on the undersides, cutouts 49 for the rollers 15. The rail elements 19 serve for supporting the first grate carriage 5 on a grate trough. Moreover, the top side of the wedge-shaped rail element 19 serves as a running surface 17 for the rollers 15. The piston rod 31 of the first cylinder/piston subassembly 25 is connected to the first longitudinal member 9 via an articulation 33 fitted on the underside of the longitudinal member 9. The piston rod 31 of the second cylinder/piston subassembly 43 is connected to the third longitudinal member 45 of the second grate carriage 35 via an articulation 33. The guide grooves 23 interact with the guide noses 41 and ensure that the second grate carriage 35 moves on a predetermined track.

Figure 5:
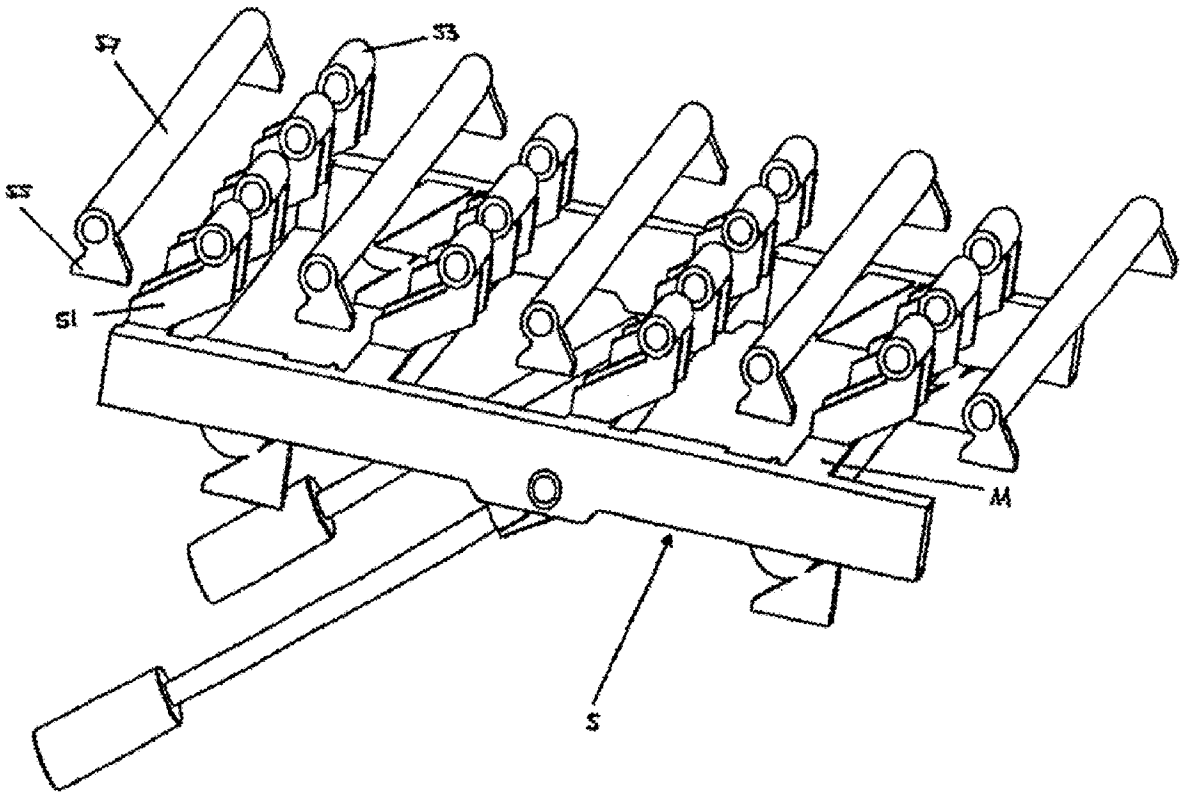
FIG. 5 shows a first grate carriage with first brackets and first block-holding-tube portions.

FIG. 5 shows the first grate carriage 5. First s-shaped brackets 51 are arranged on the first crossmembers 11. The first block-holding-tube portions 53 are arranged on the first s-shaped brackets 51. These two portions are intended for bearing a first number of grate blocks of the moveable rows of grate blocks. In this case, three to four grate blocks are assigned in each case to a first block-holding-tube portion 53, these grate blocks together forming a group of grate blocks. The first block-holding-tube portions 53 extend only over part of the first crossmember 11. It is preferable for three to four first brackets 51 to be arranged on a first crossmember 11. Stationary brackets 55 with the stationary block-holding-tubes 57 arranged thereon are shown schematically between the first brackets 51 arranged on the first crossmembers.

Figure 6:
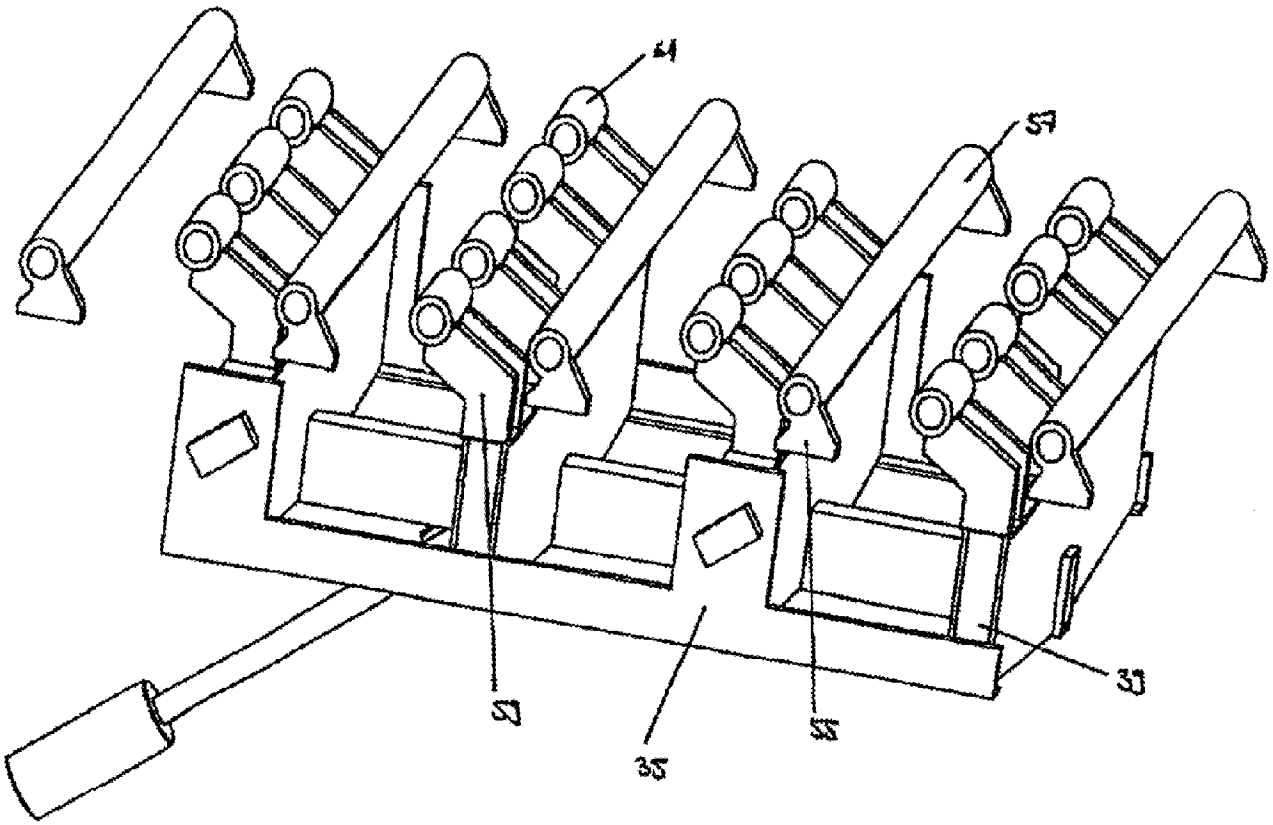
FIG. 6 shows a second grate carriage with second brackets and second block-holding-tube portions.
Figure 7:
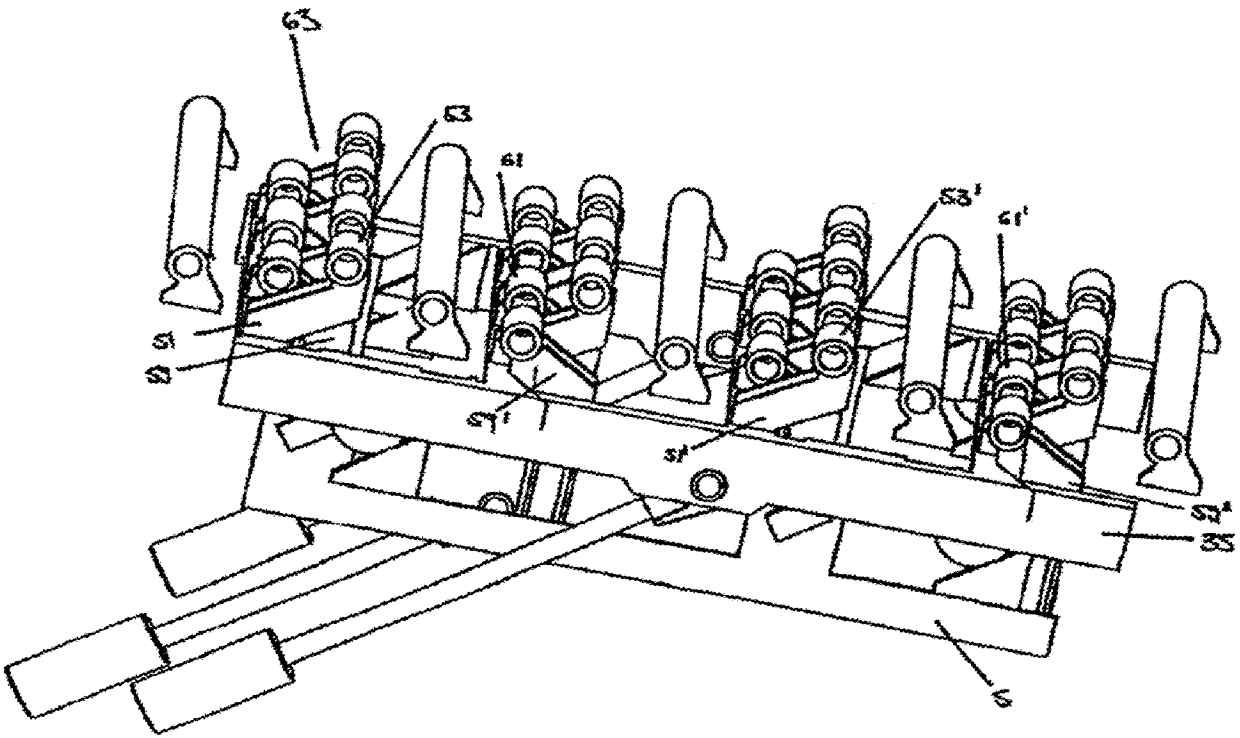
Figure 8:
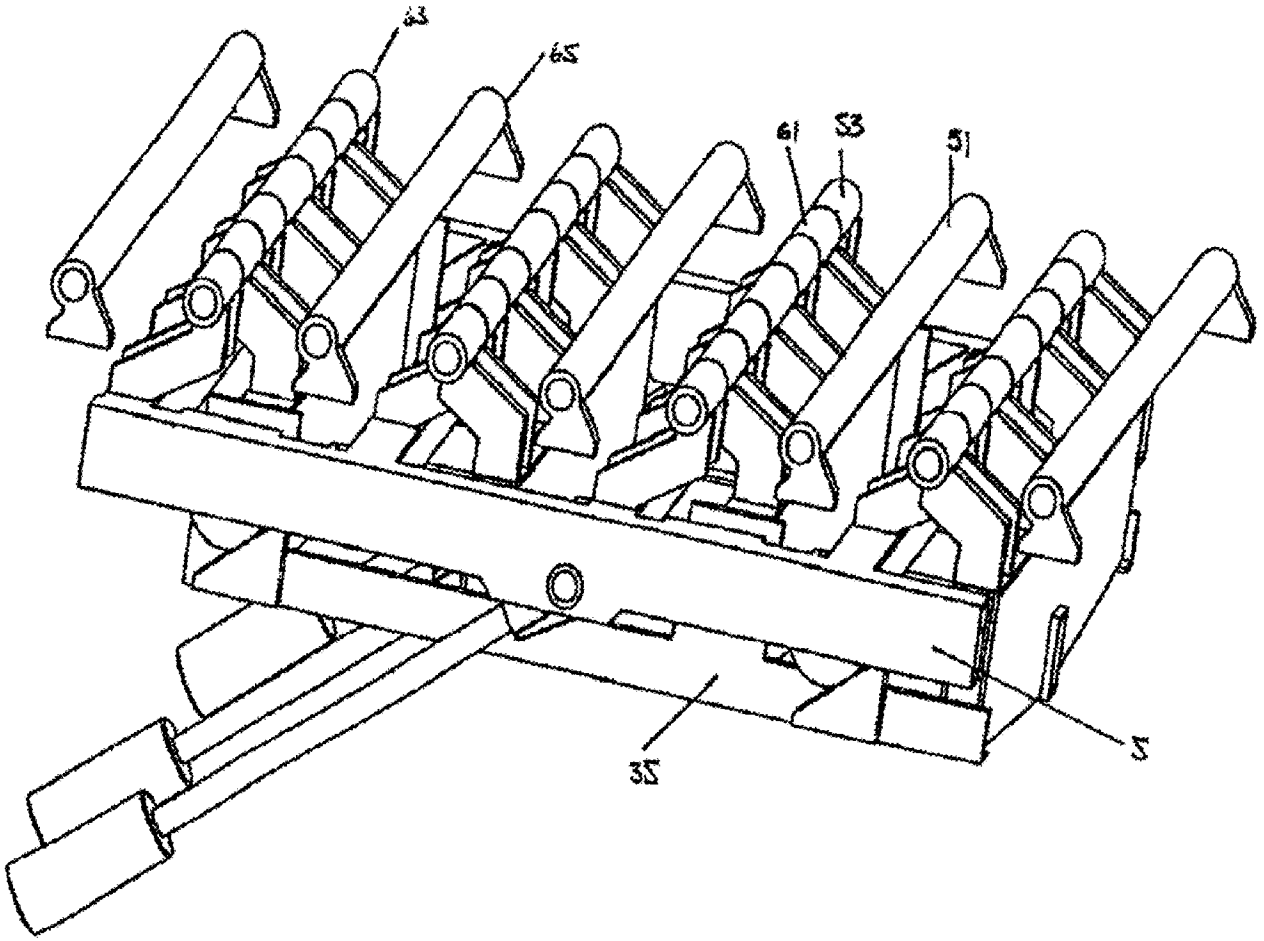
Figure 9:
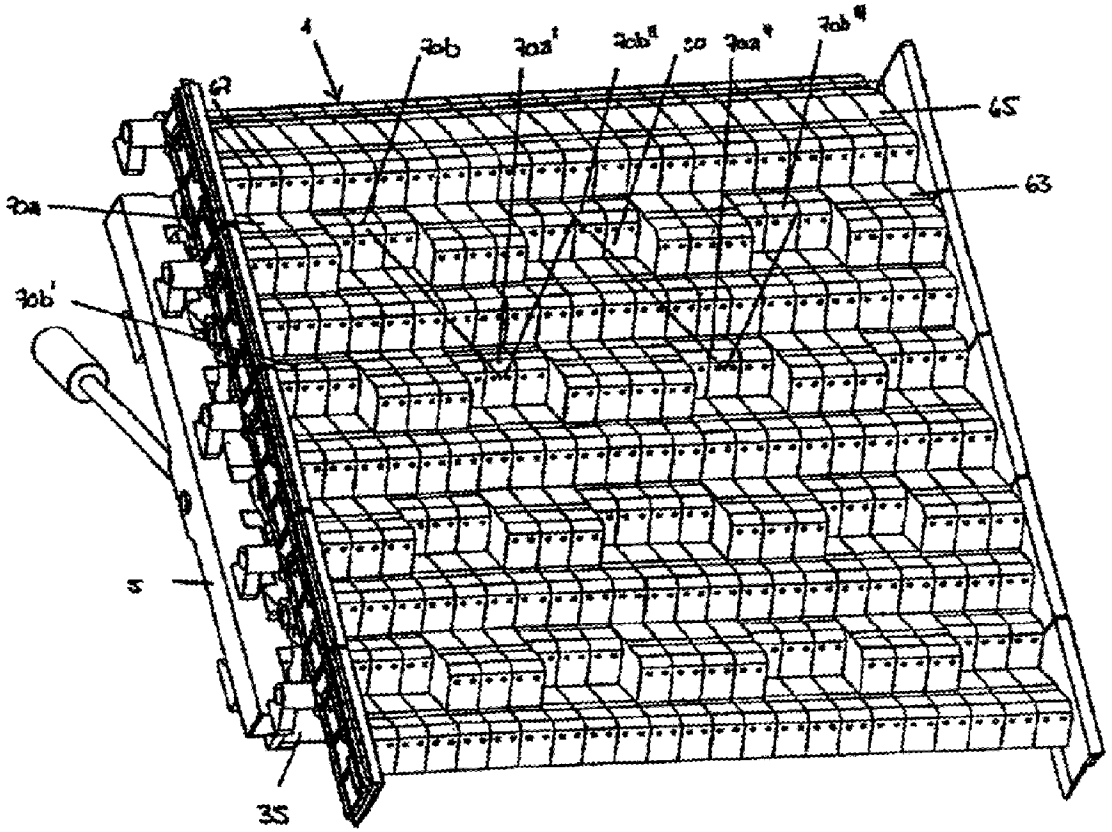
Figure 10:
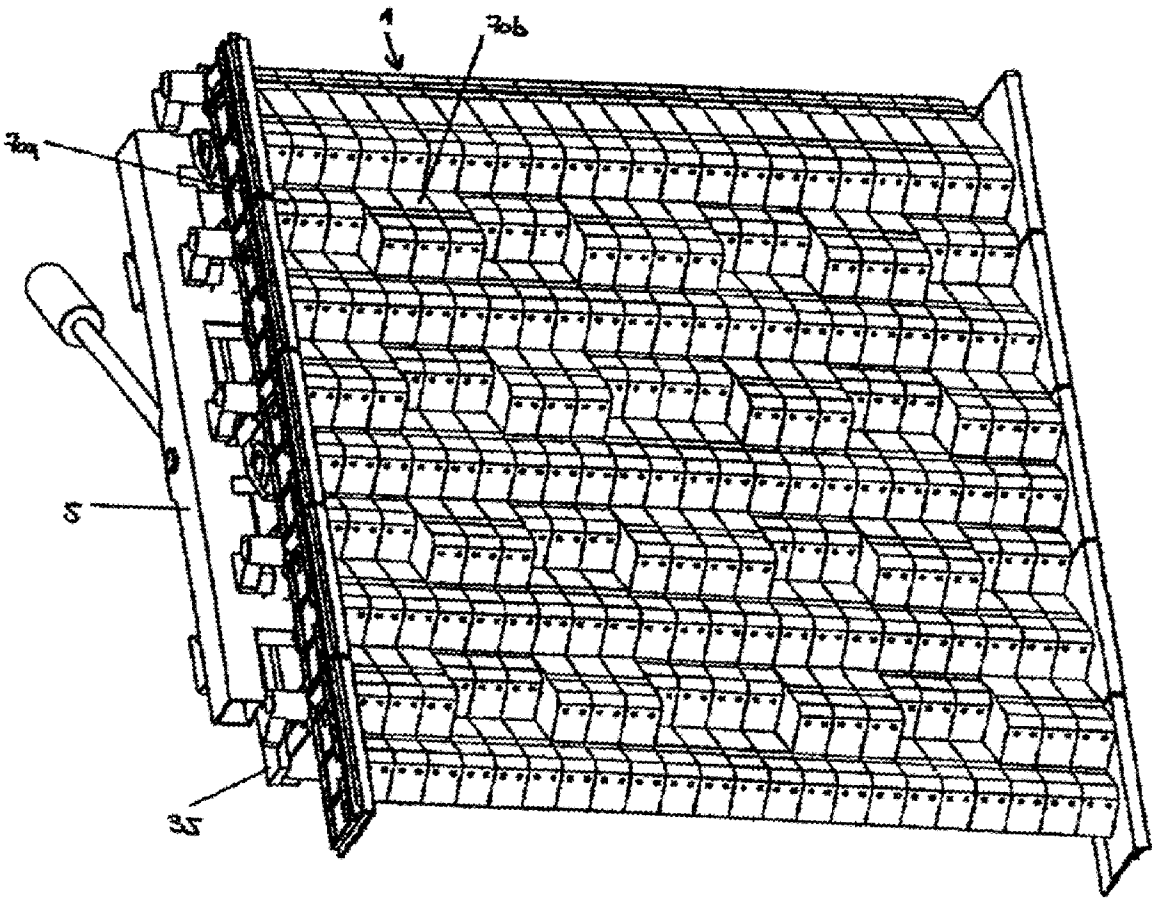
Figure 11:
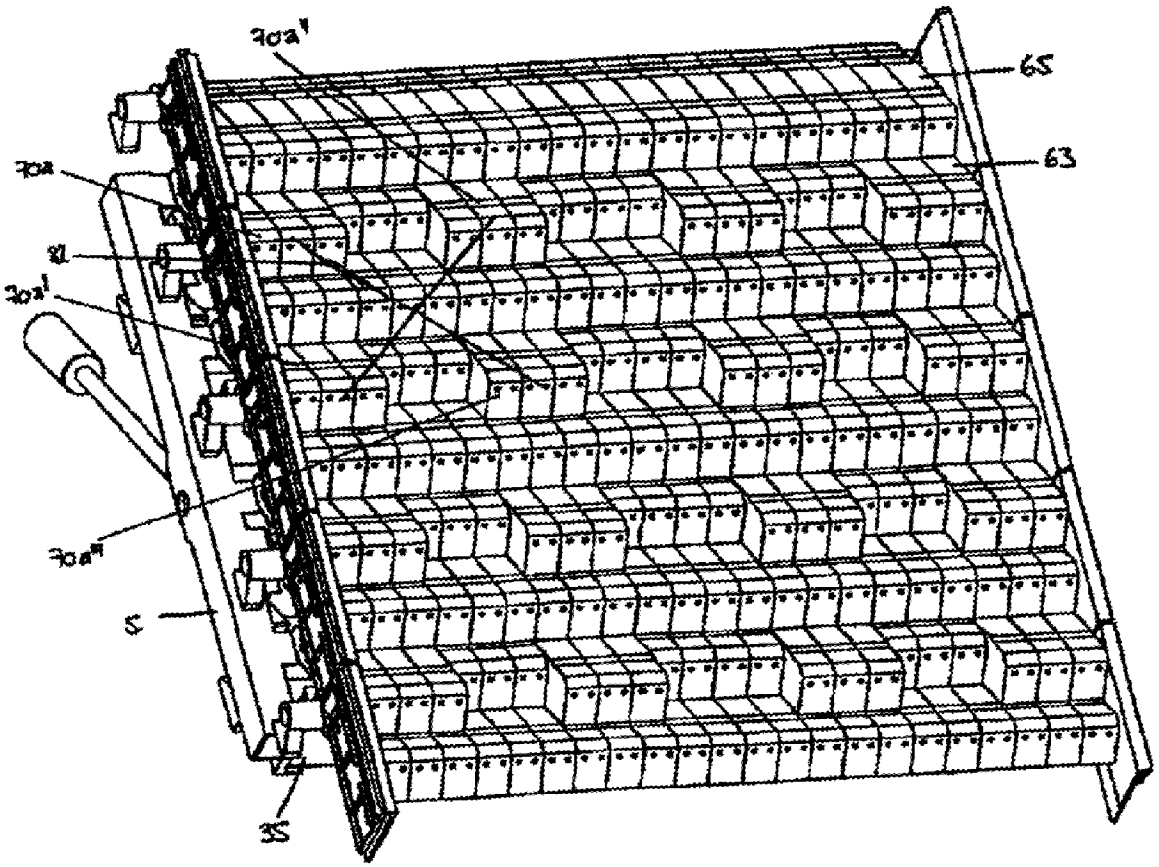
Figure 12:
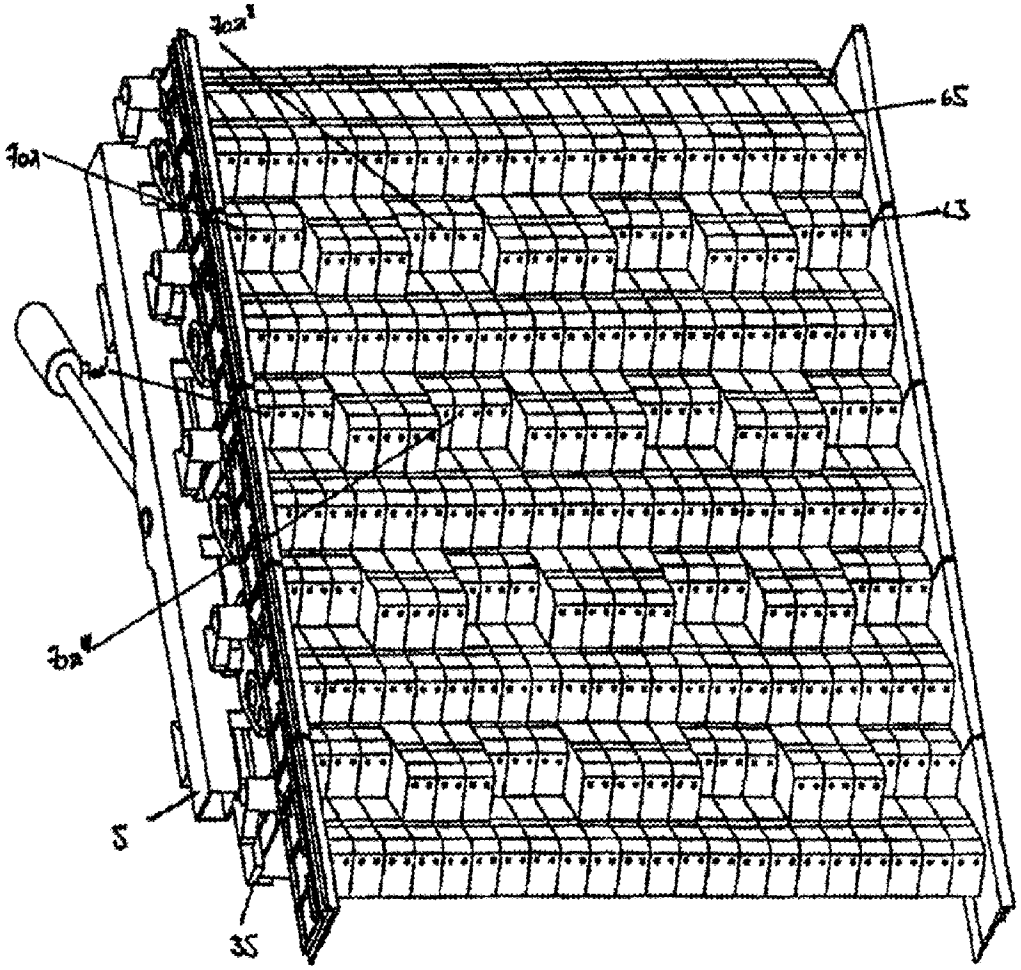
Figure 13:
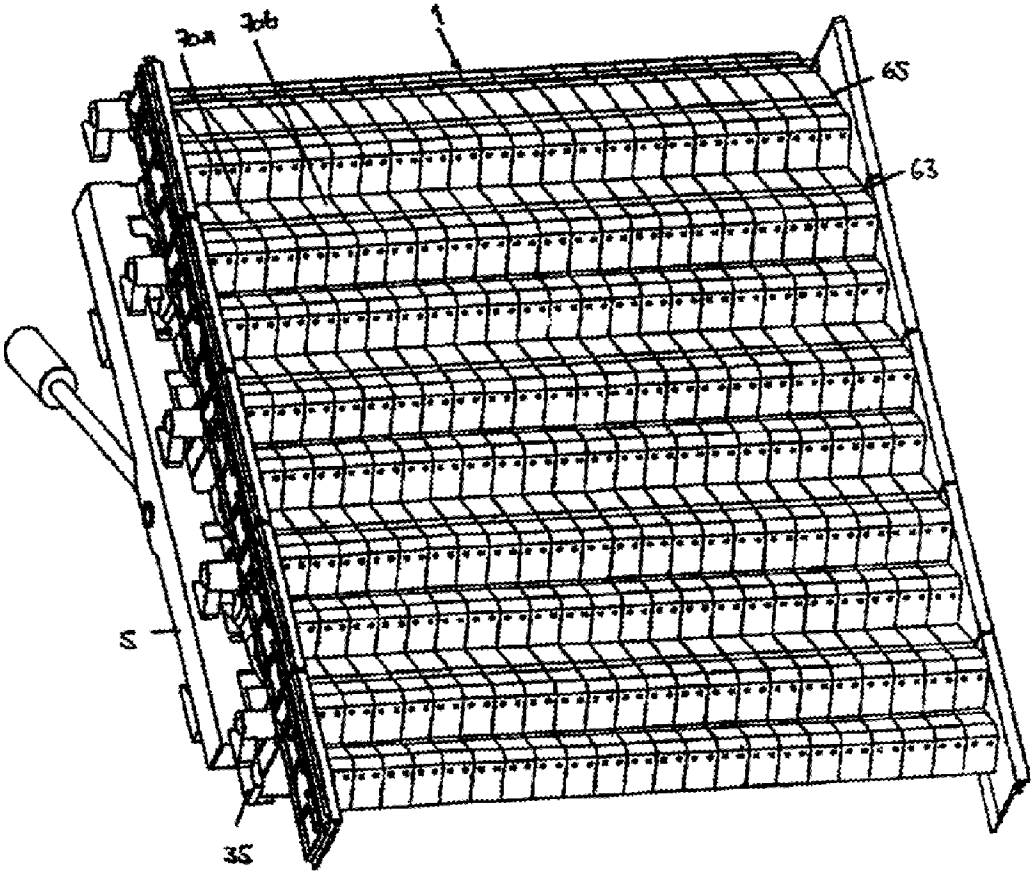
Figure 1:
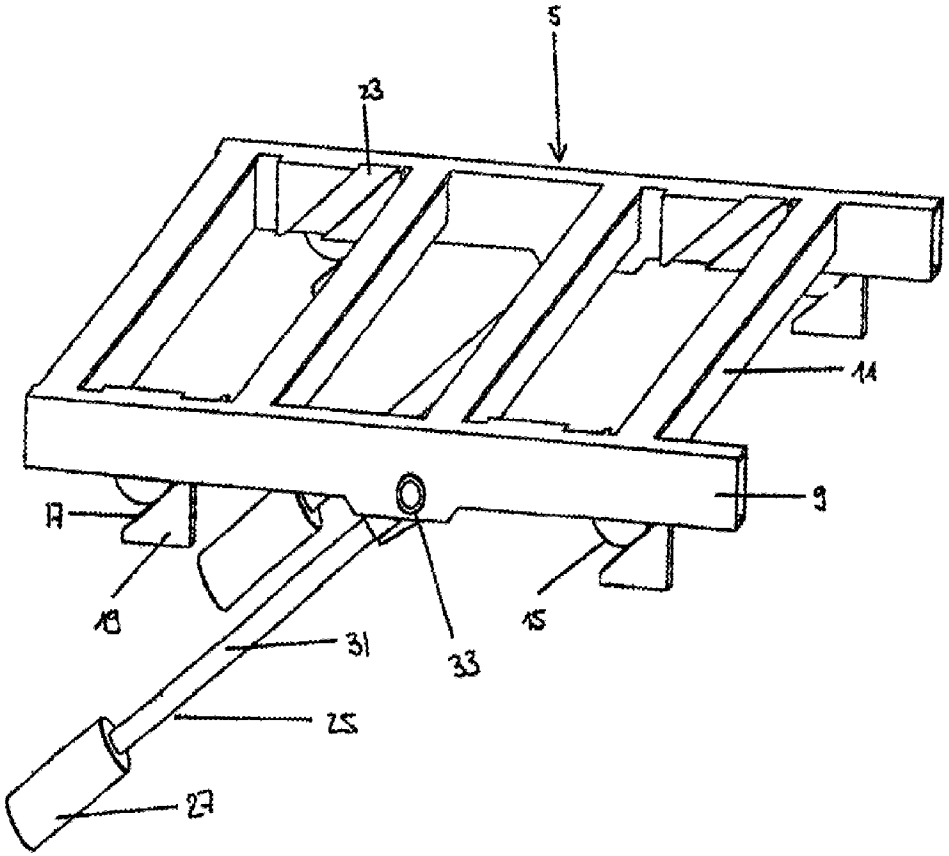
Figure 2:
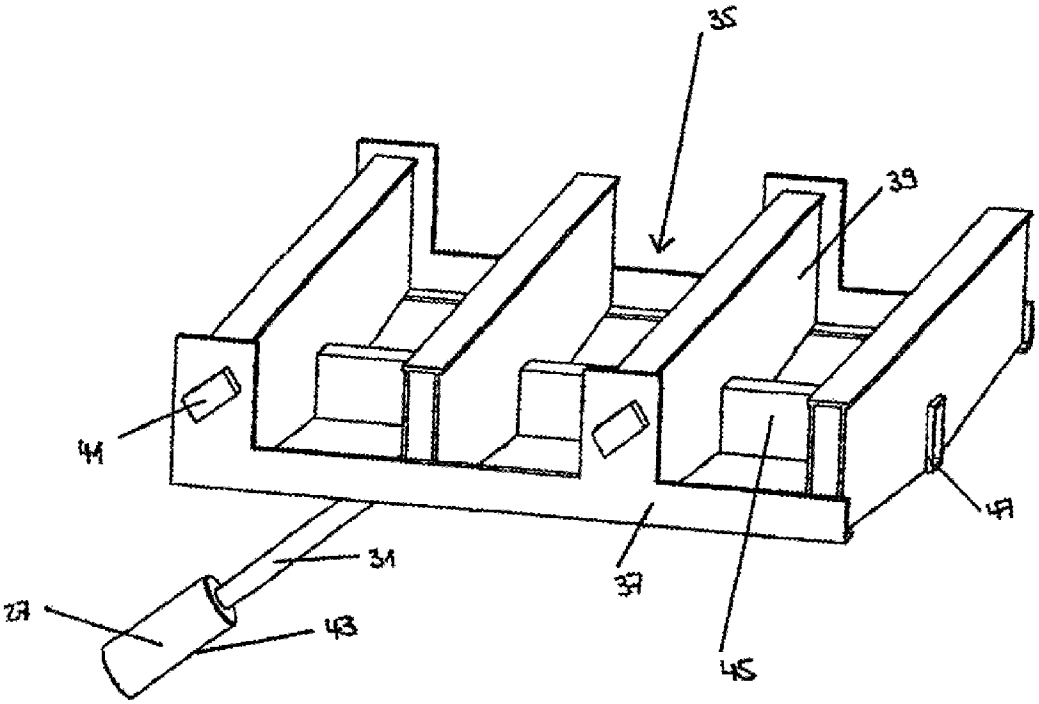
Figure 3:
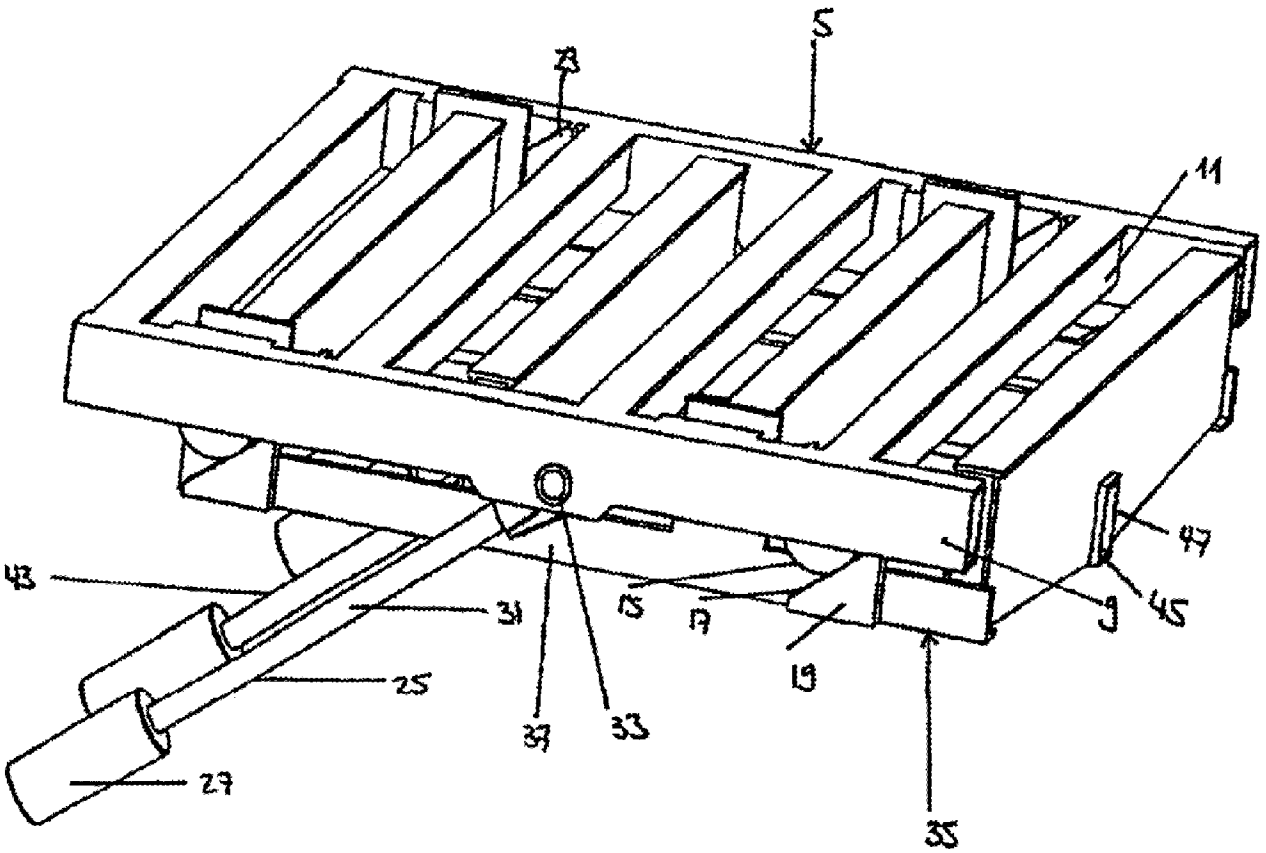
Figure 4:
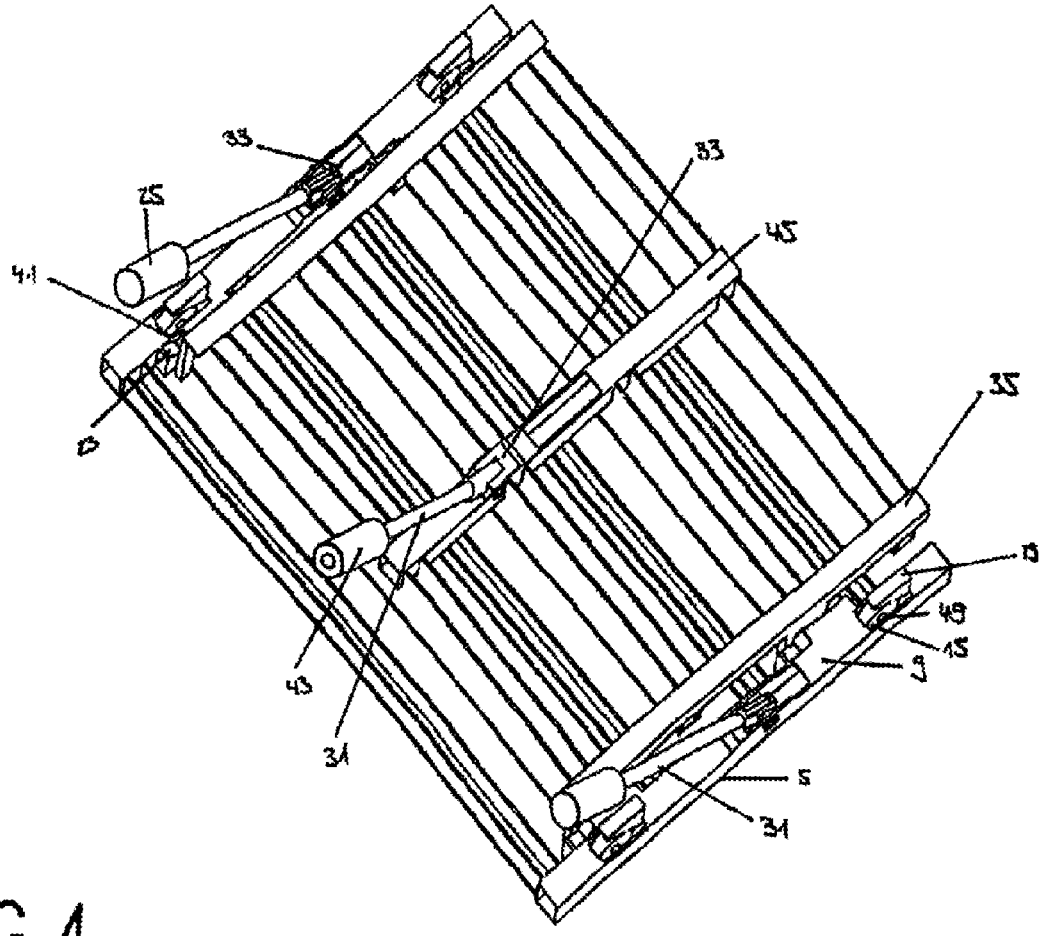
Figure 5:
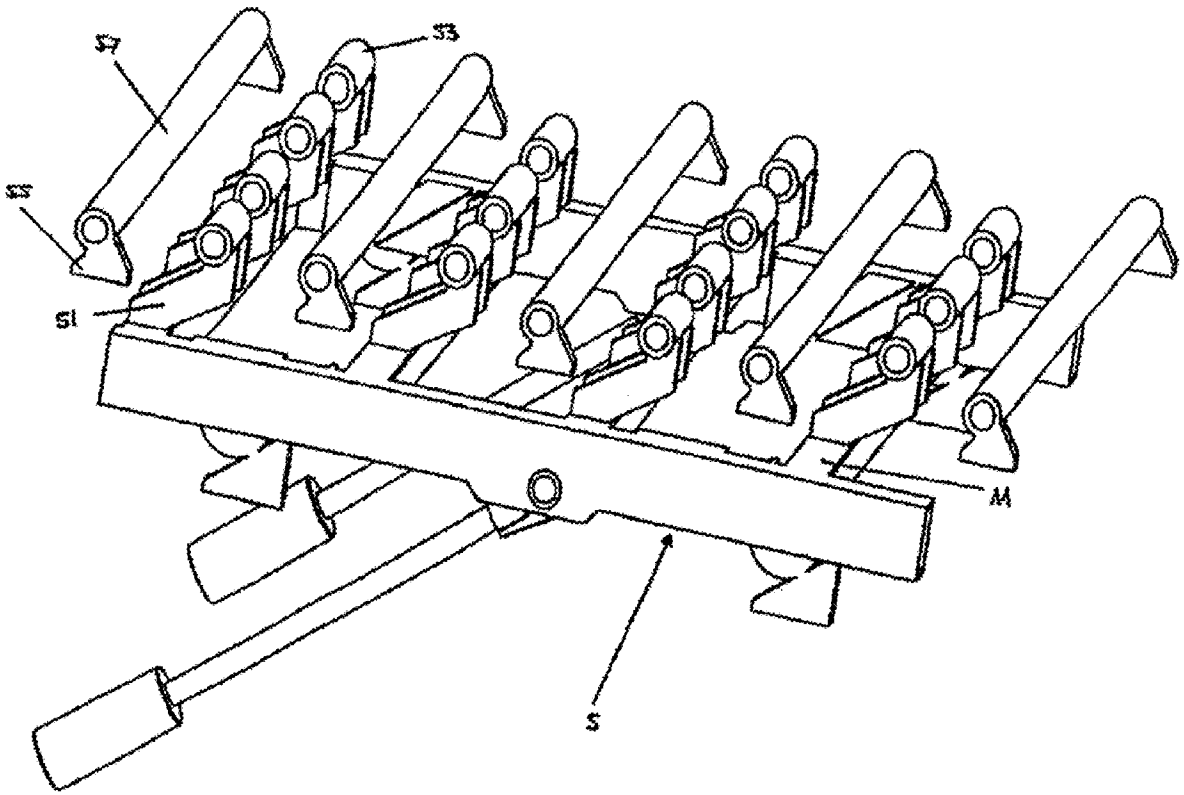
Figure 6:
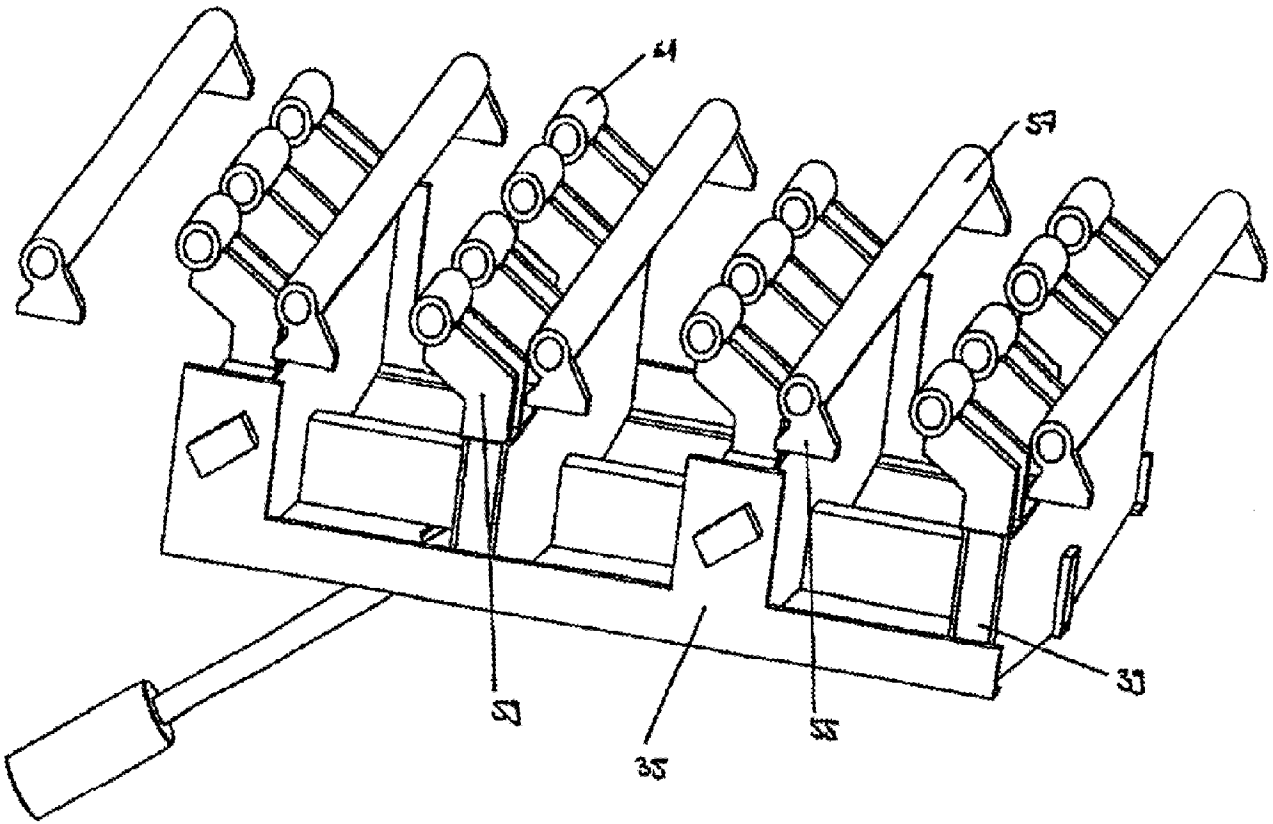
Figure 7:
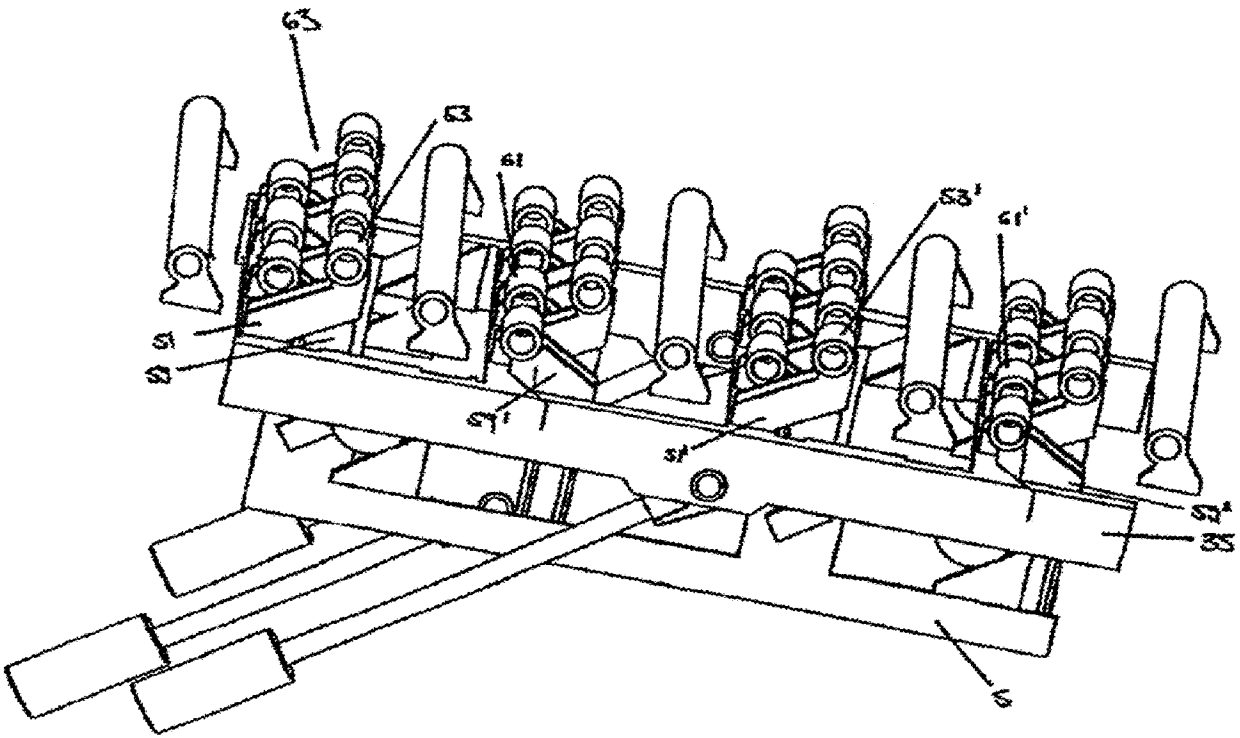
Figure 8:
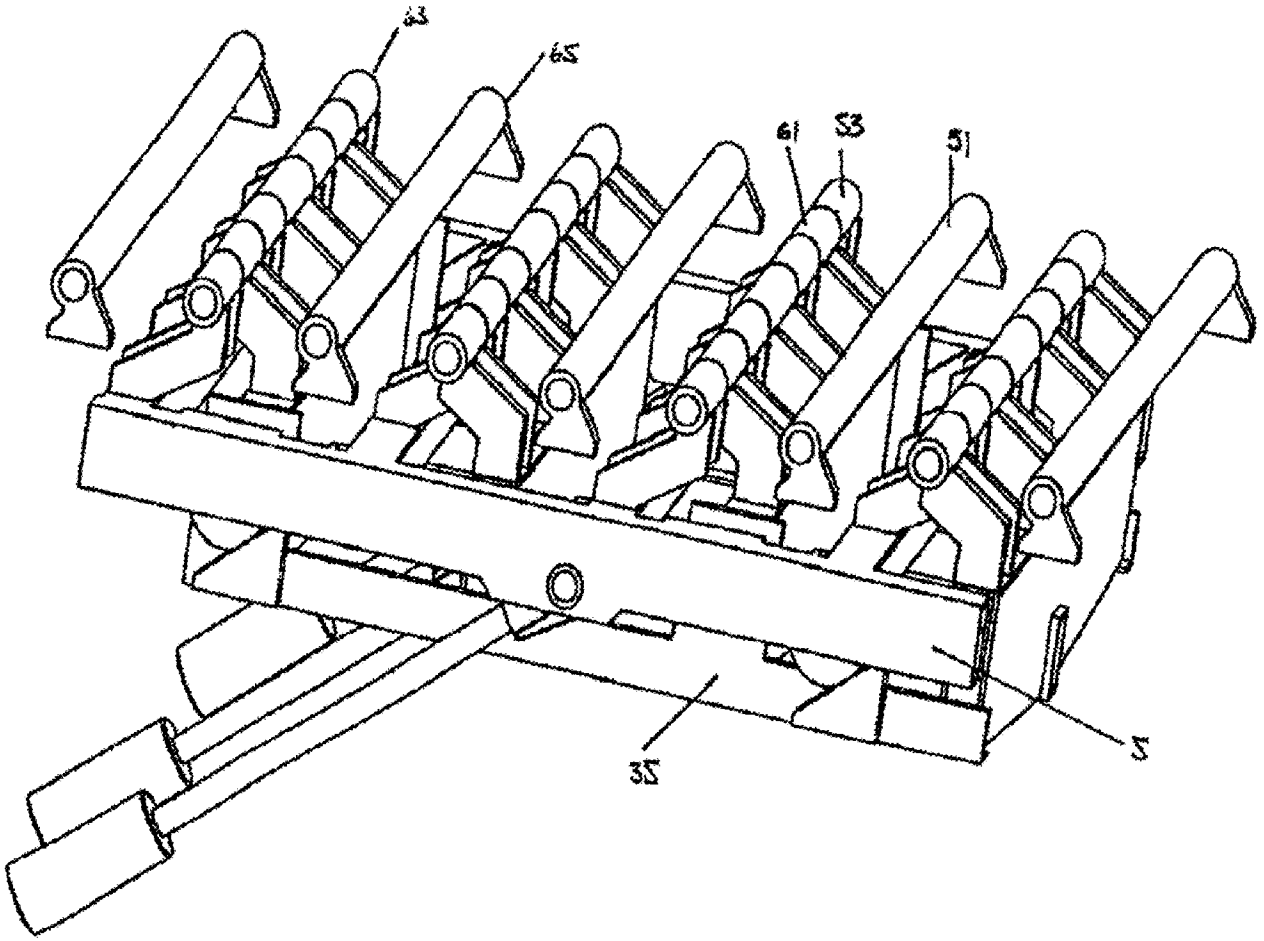
Figure 9:
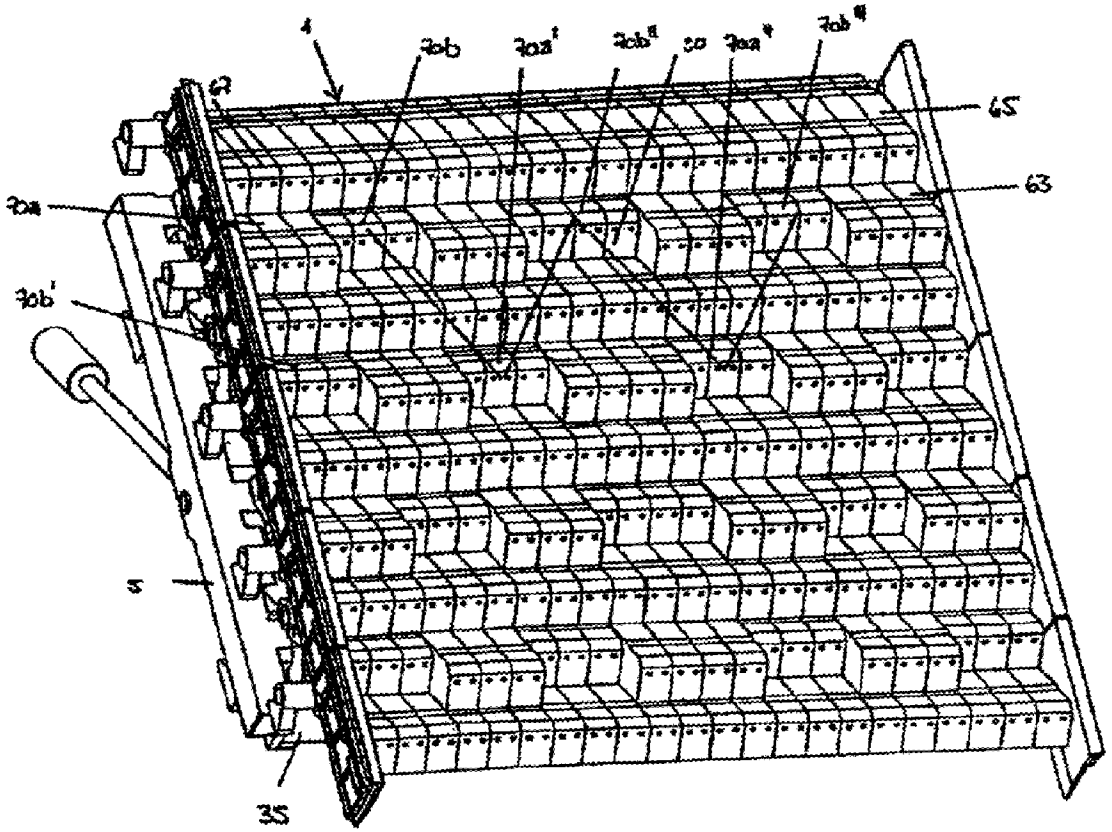
Figure 10:
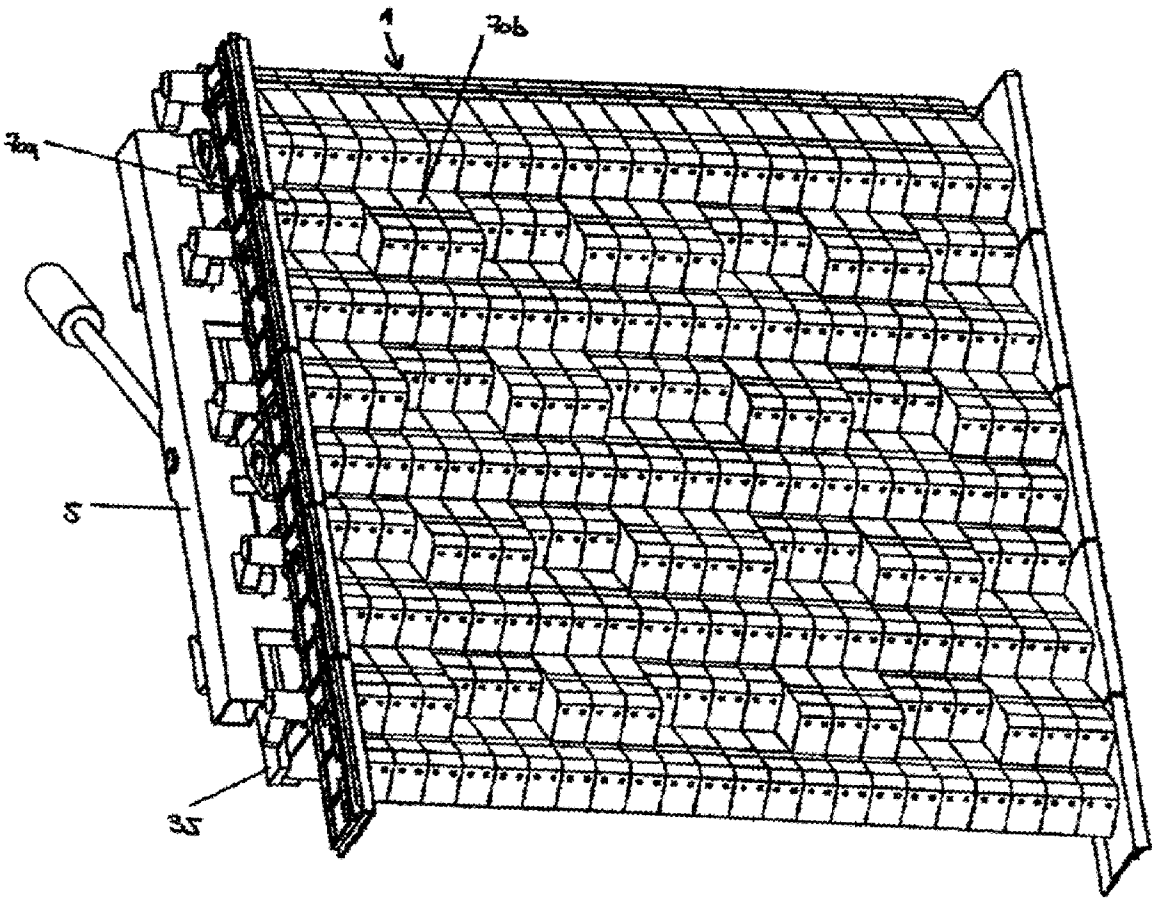
Figure 11:
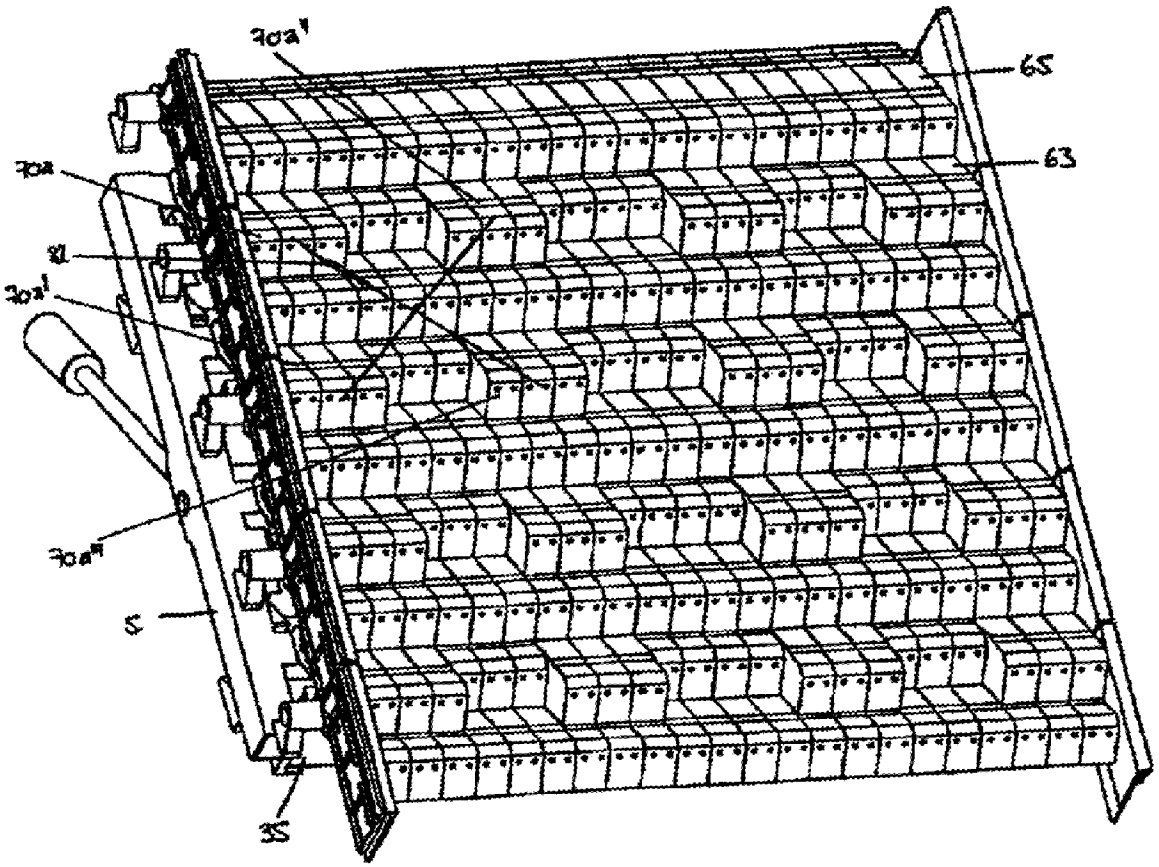
Figure 12:
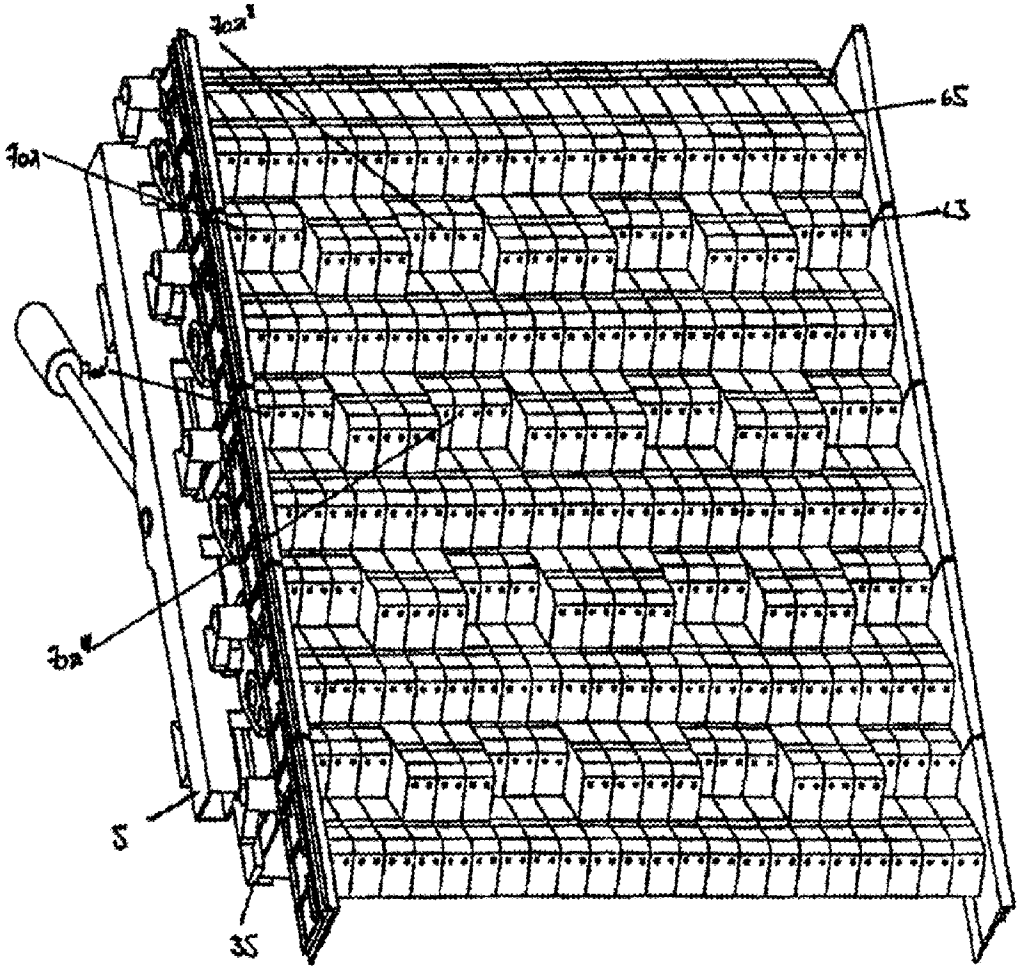
Figure 13:
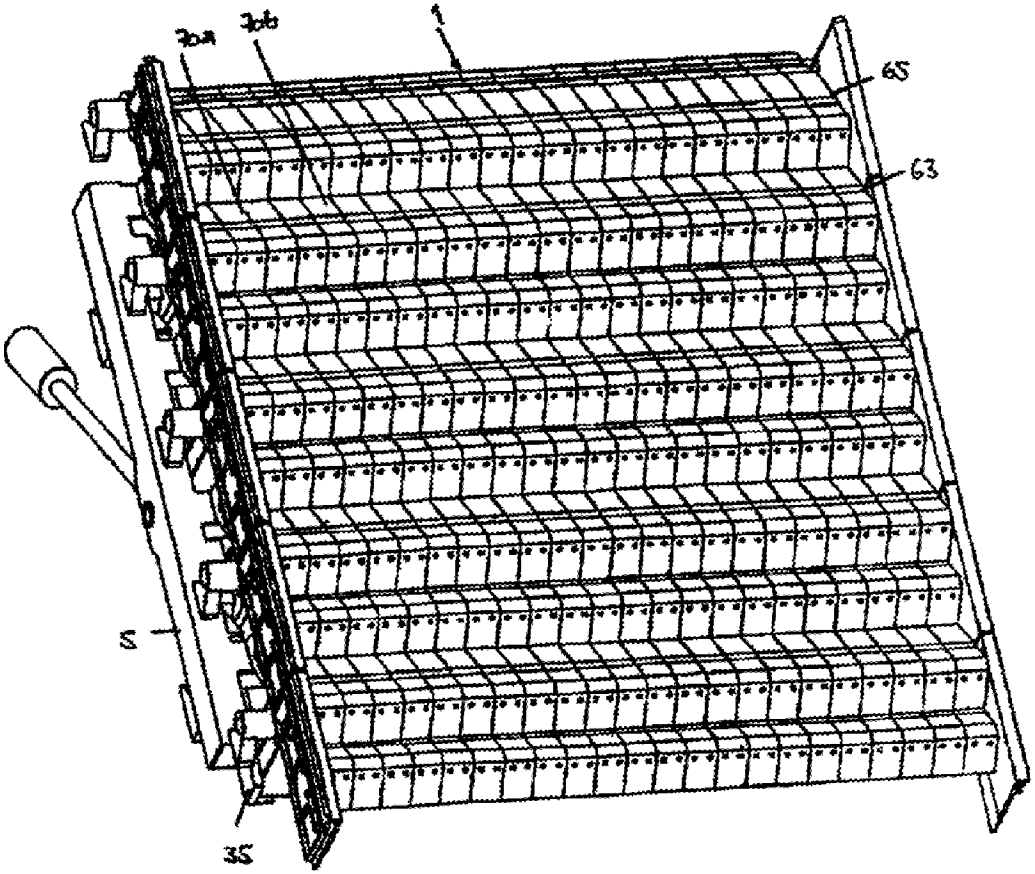
Figure 1:
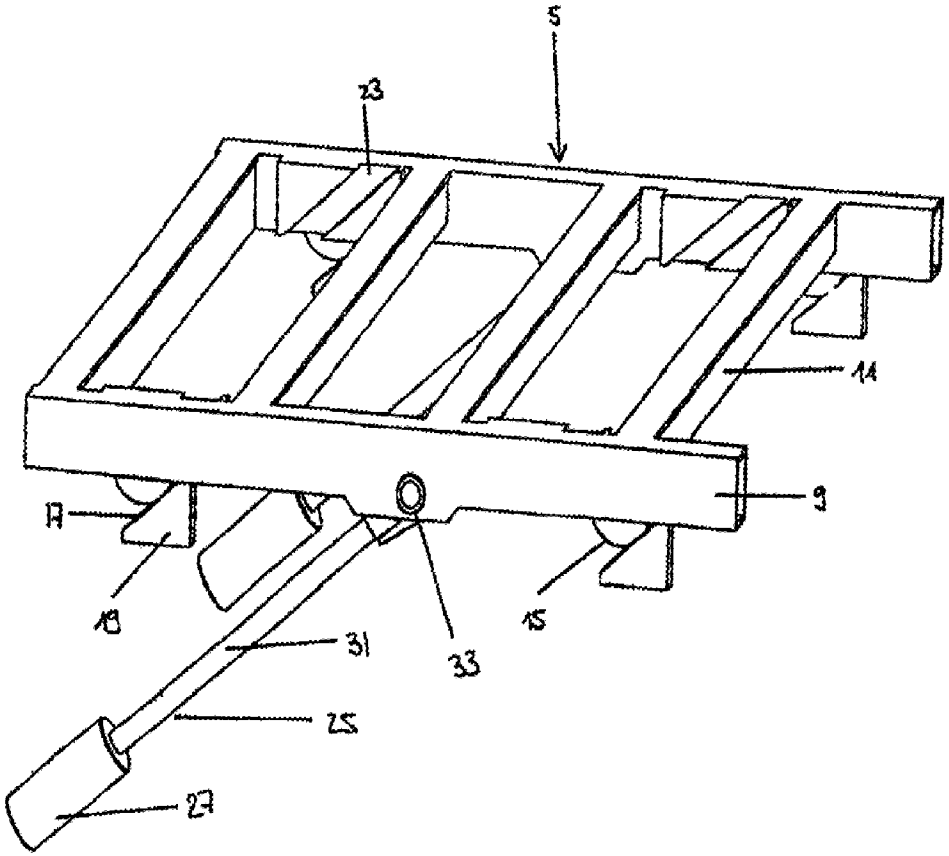
Figure 2:
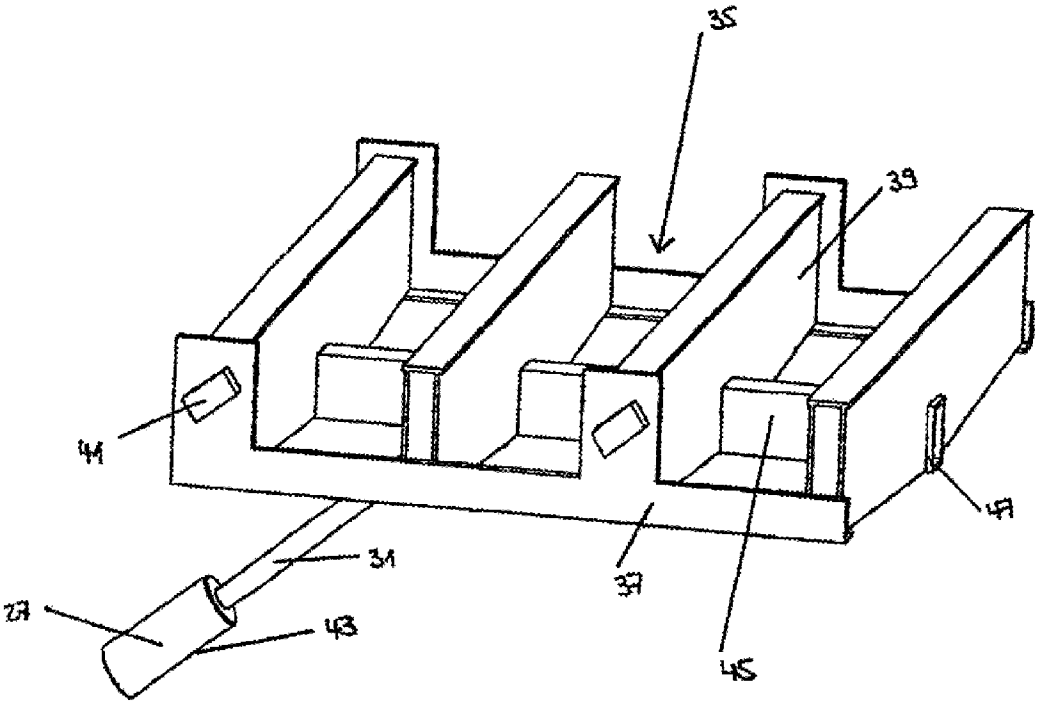
Figure 3:
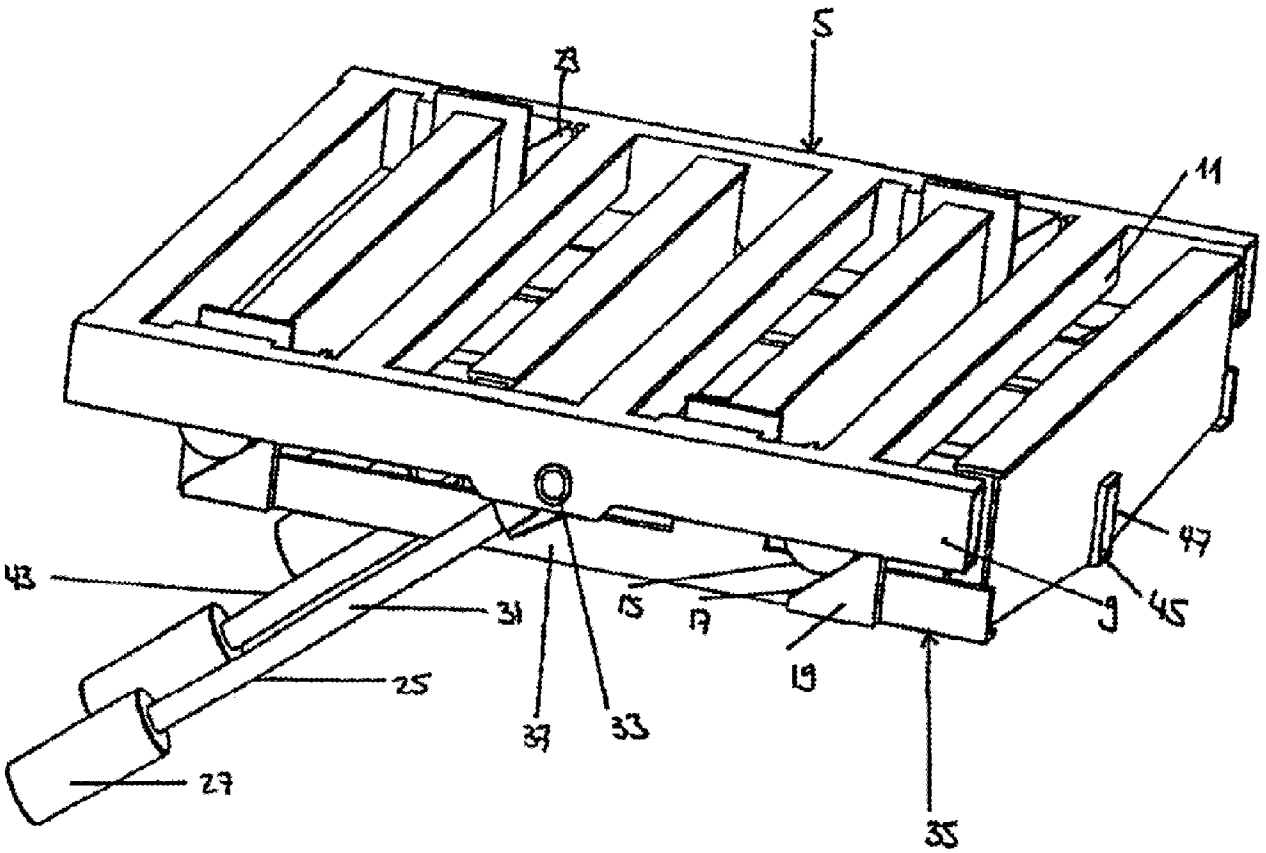
Figure 4:
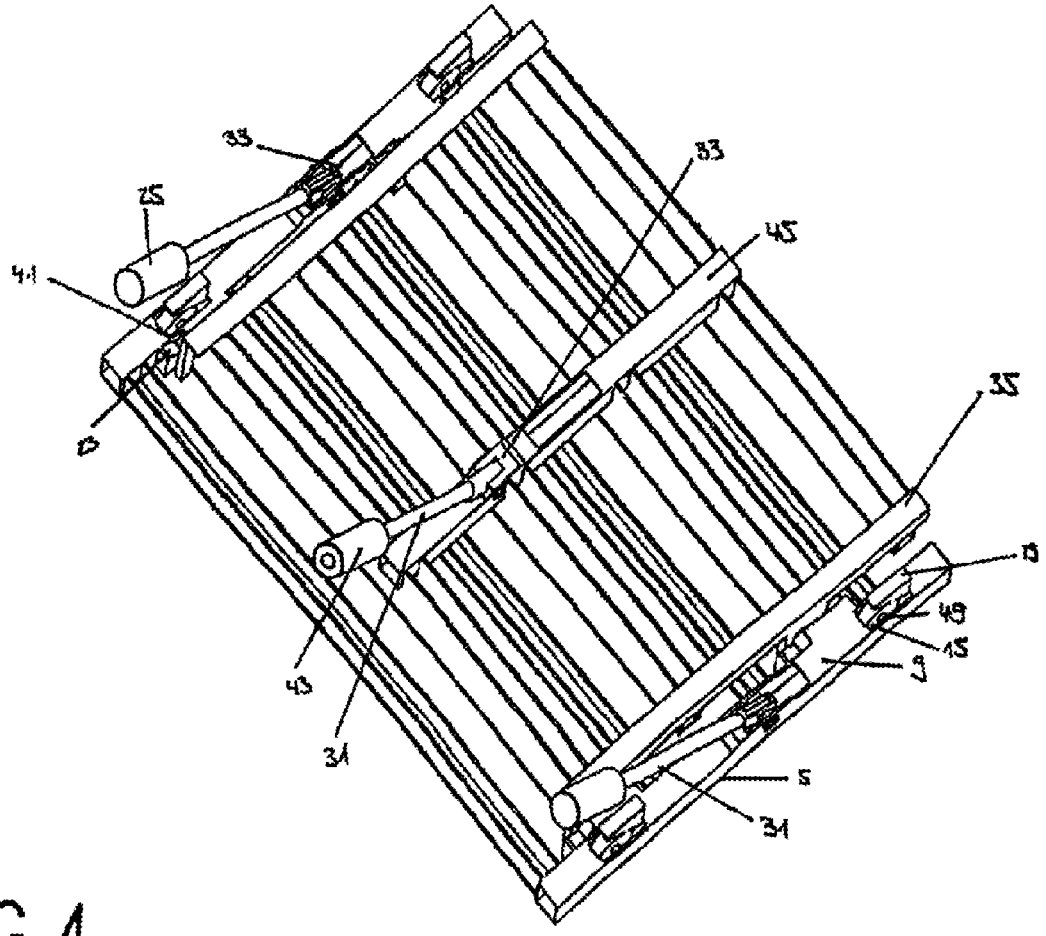
Figure 5:
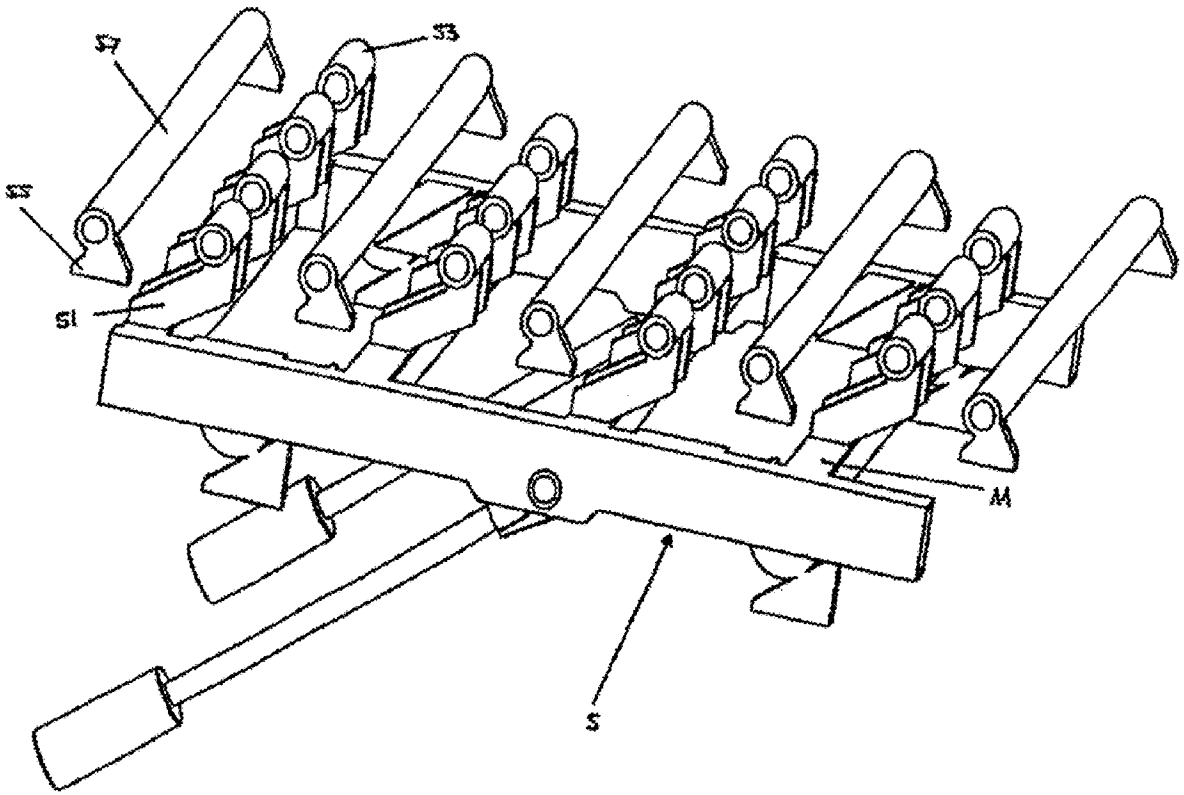
Figure 6:
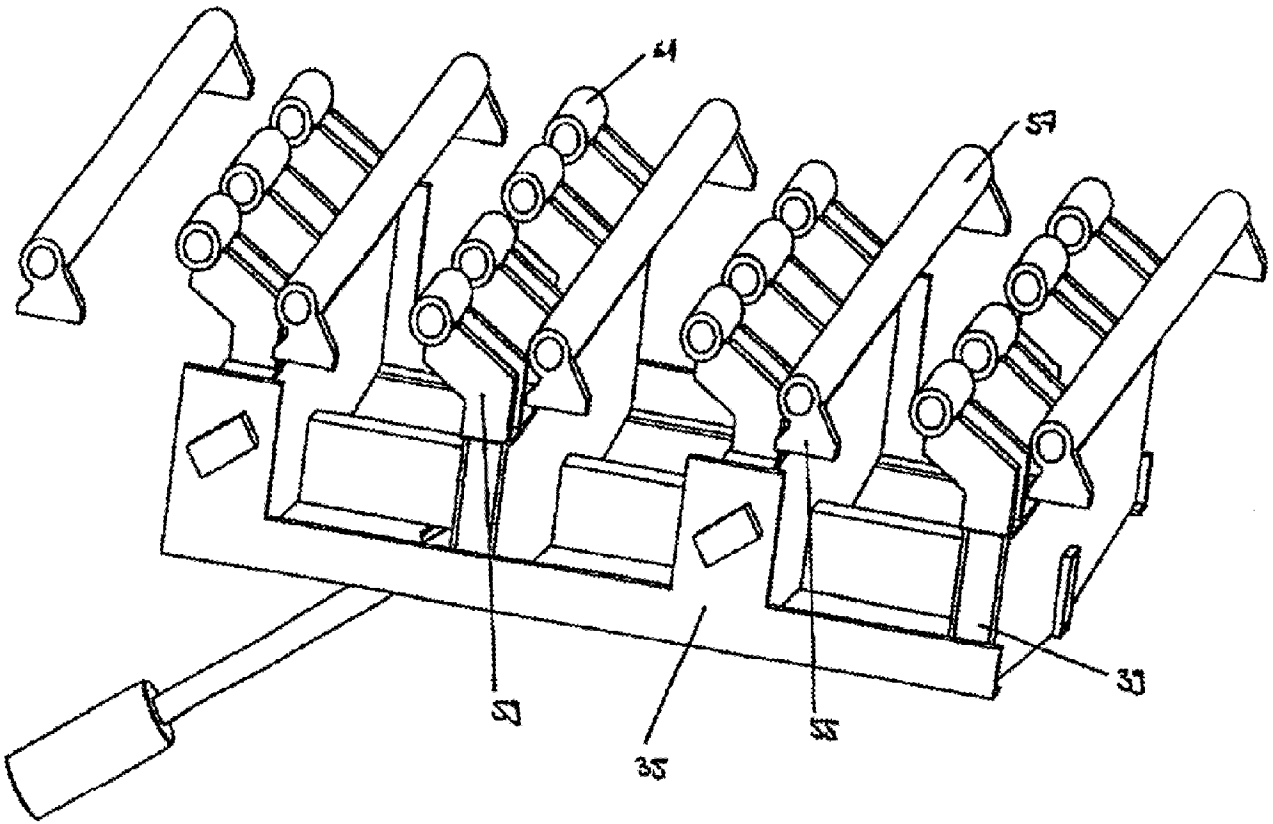
Figure 7:
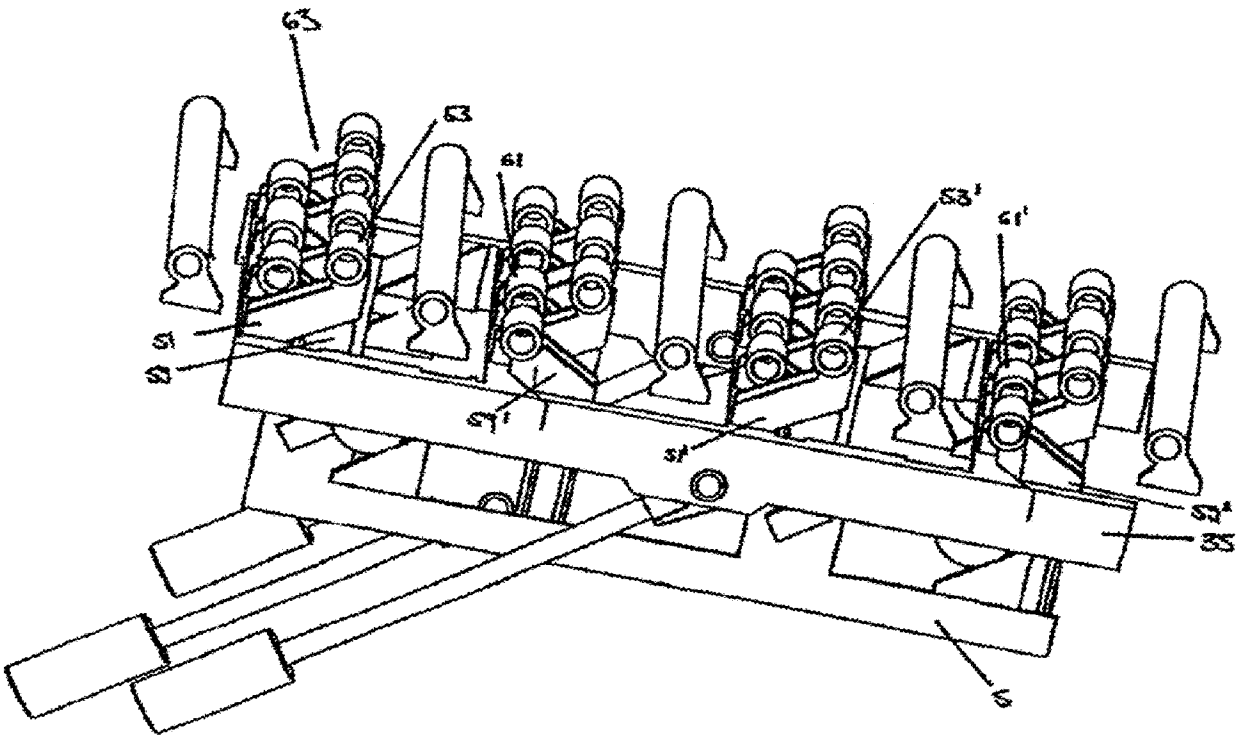
Figure 8:
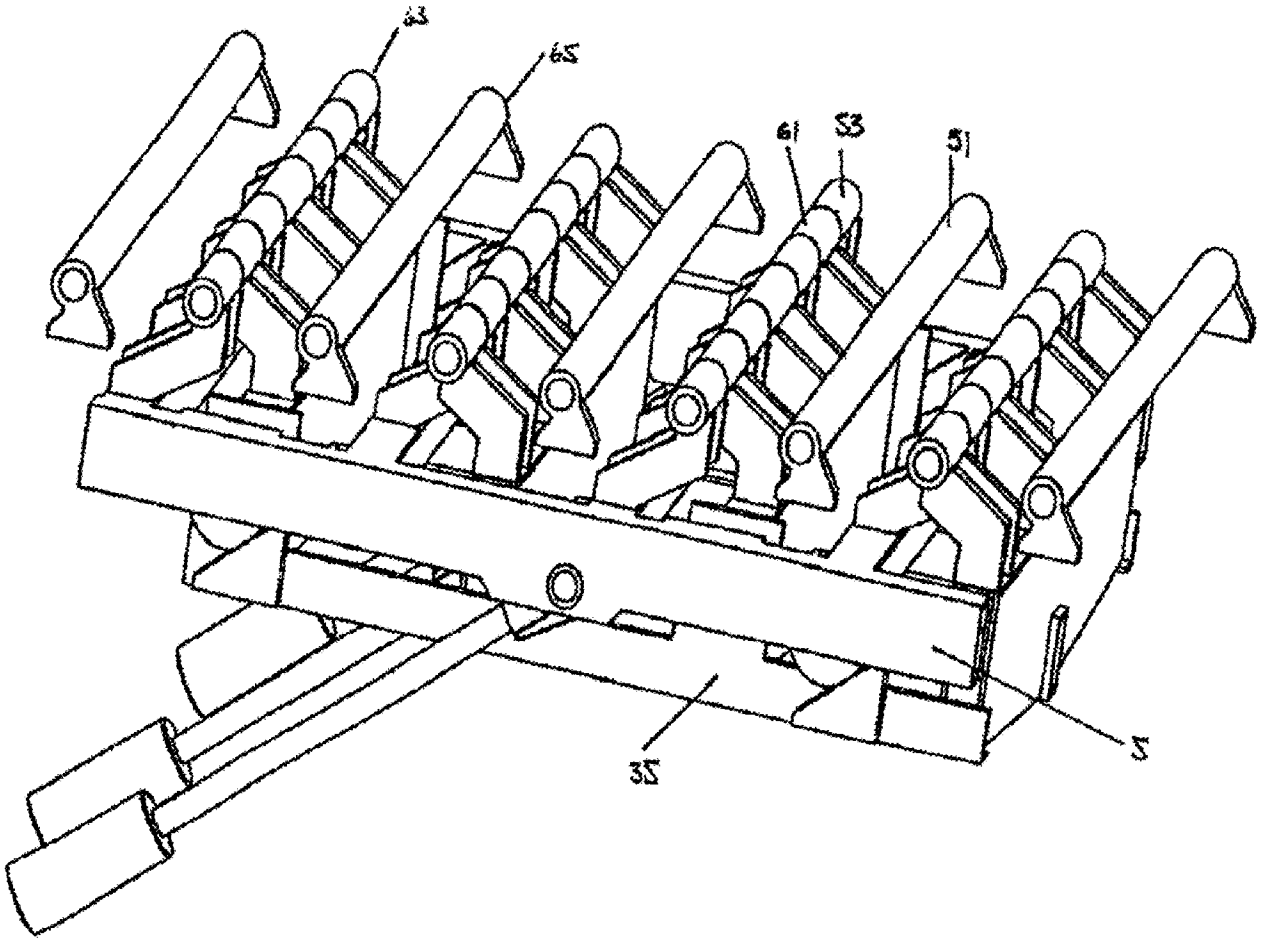
Figure 9:
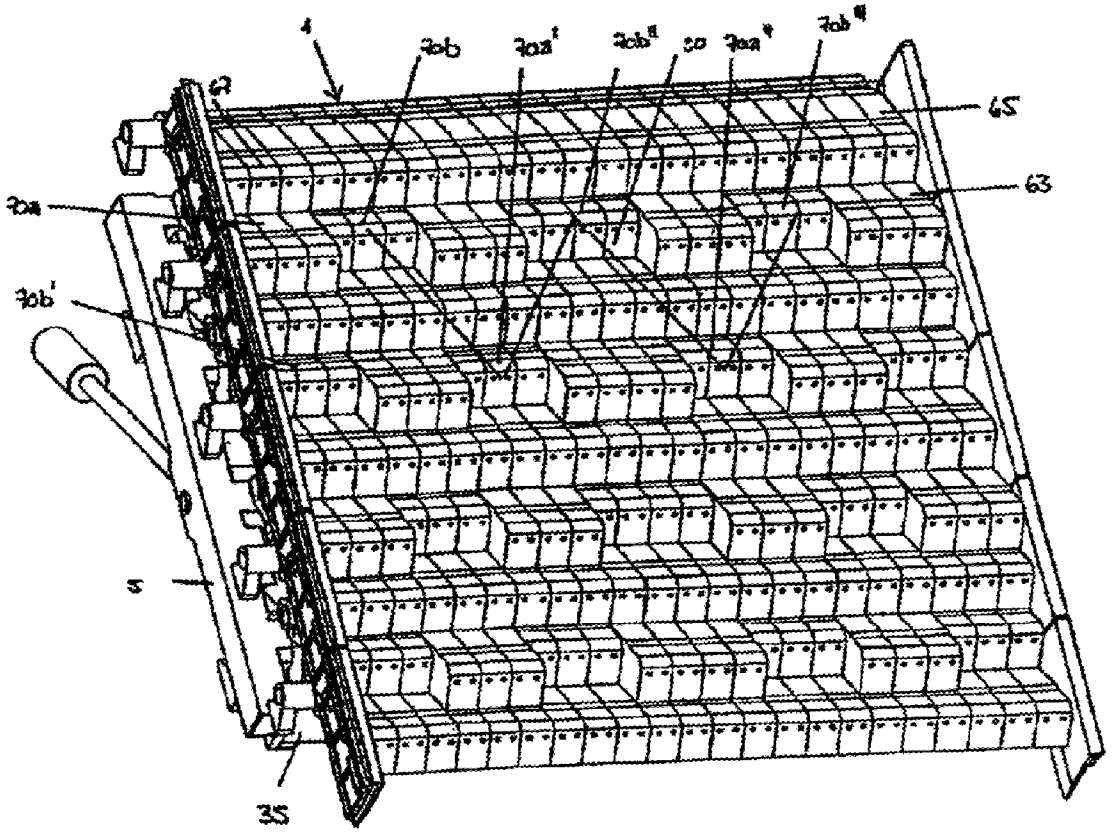
Figure 10:
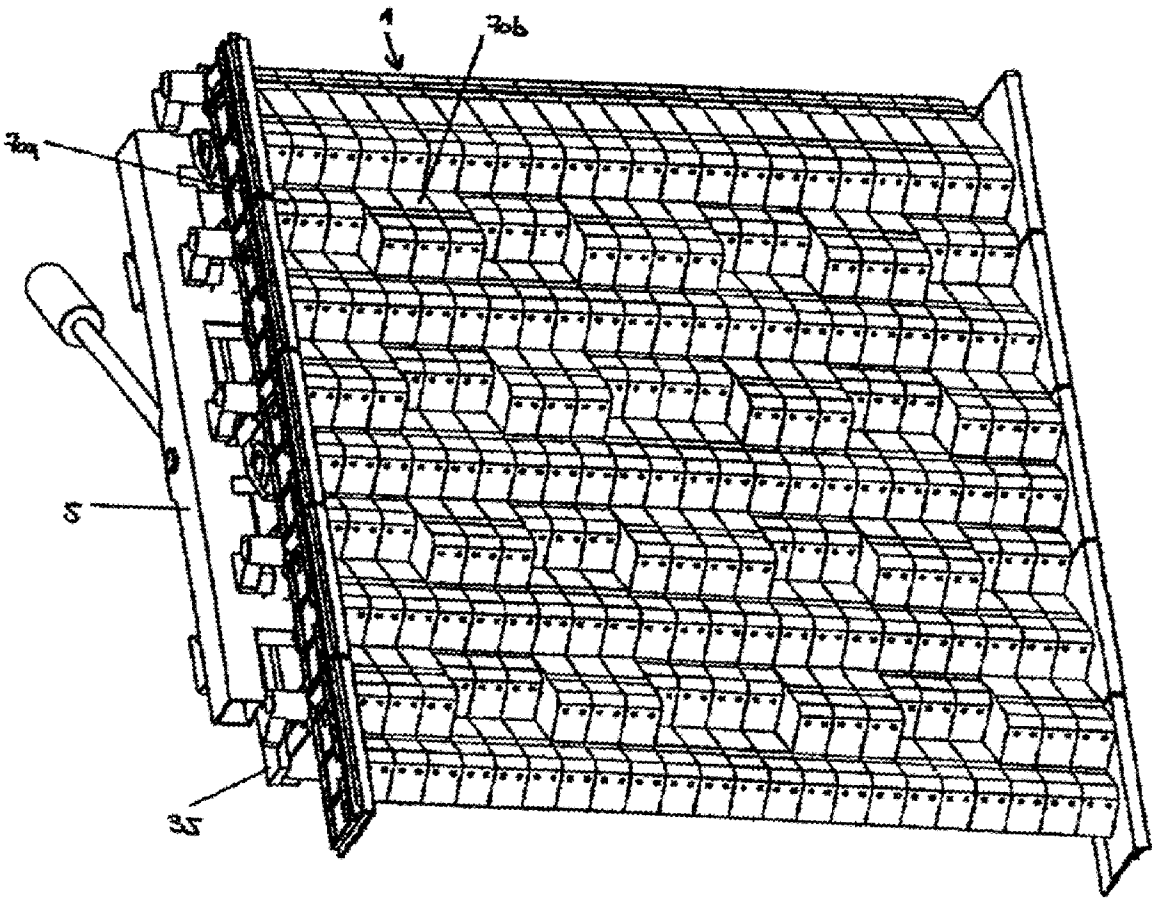
Figure 11:
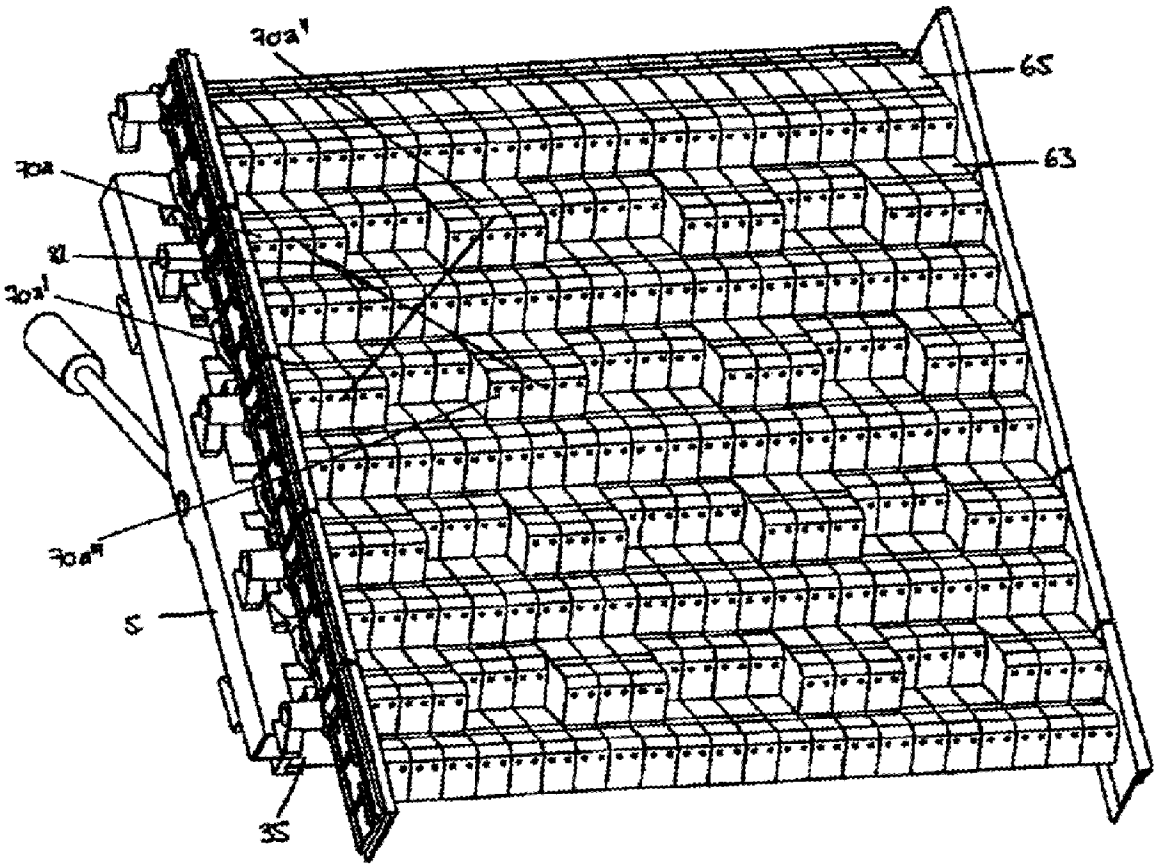
Figure 12:
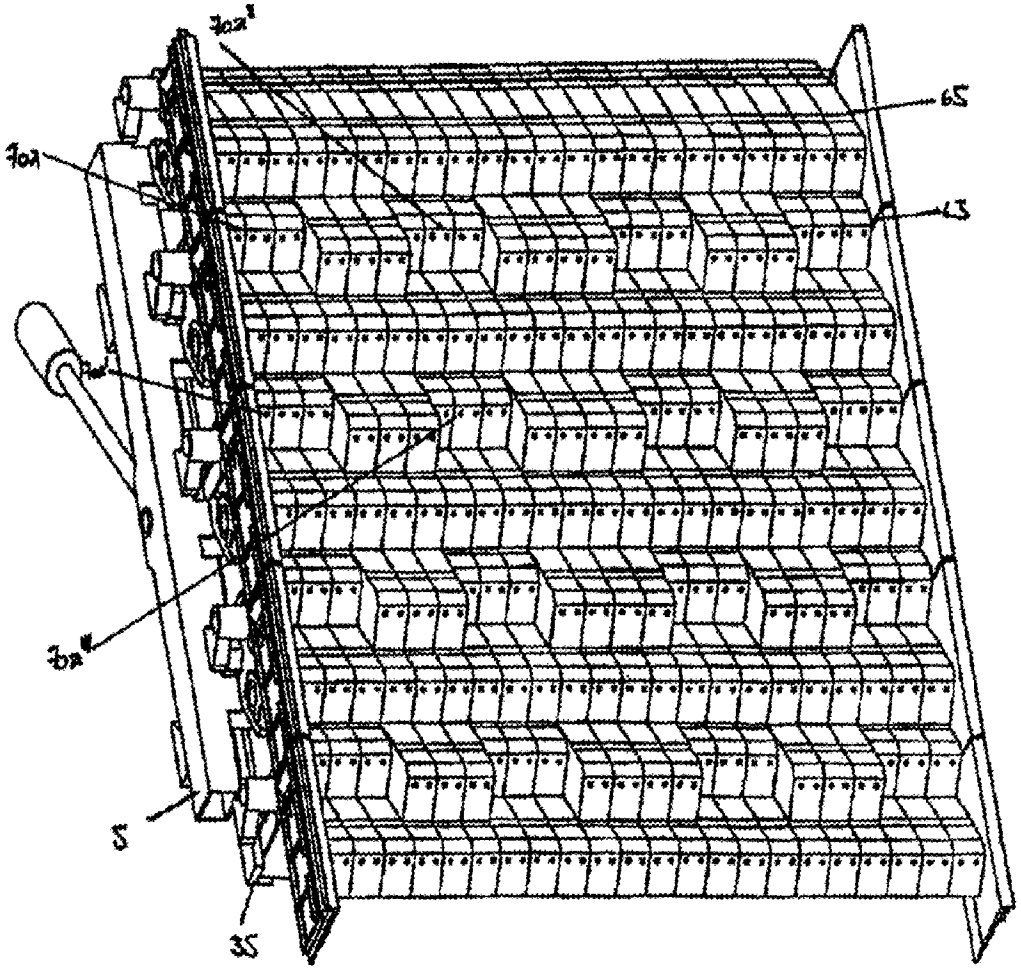
Figure 13:
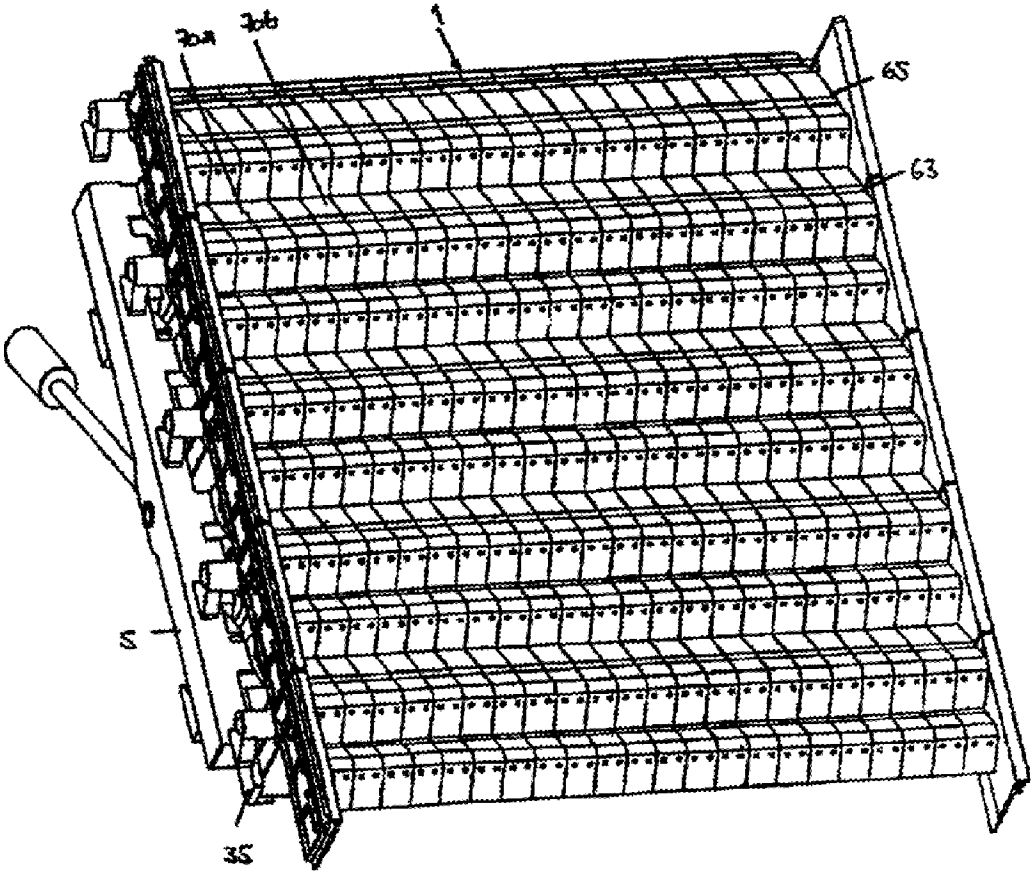
Figure 1:
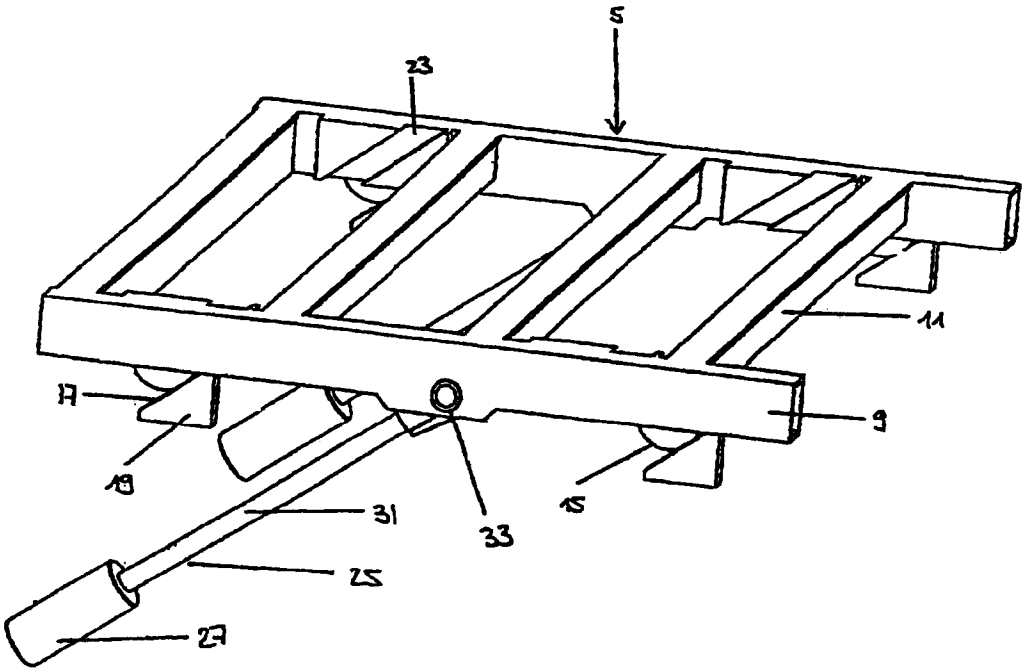
Figure 2:
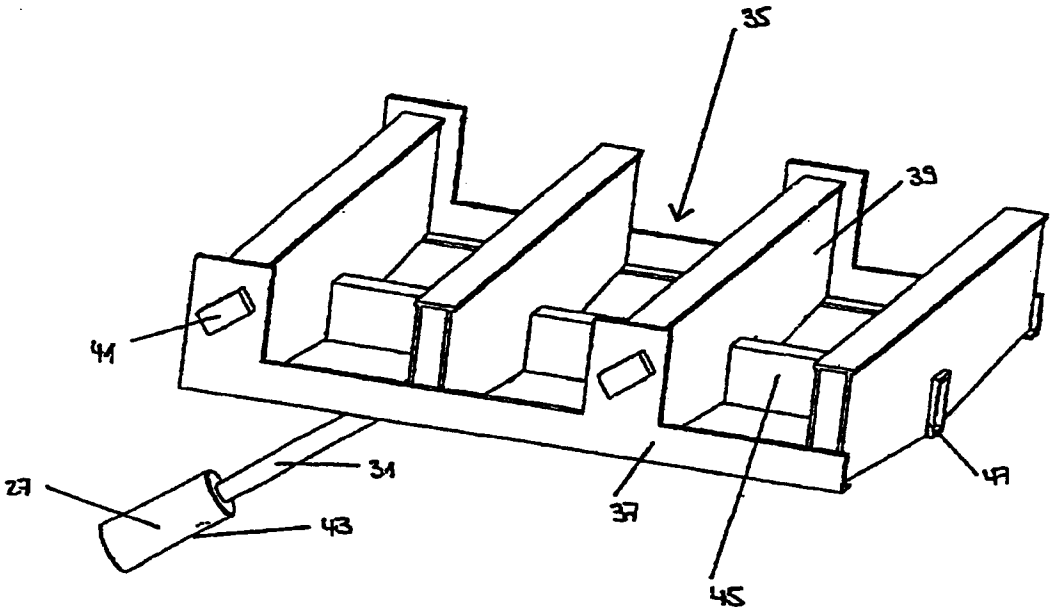
Figure 3:
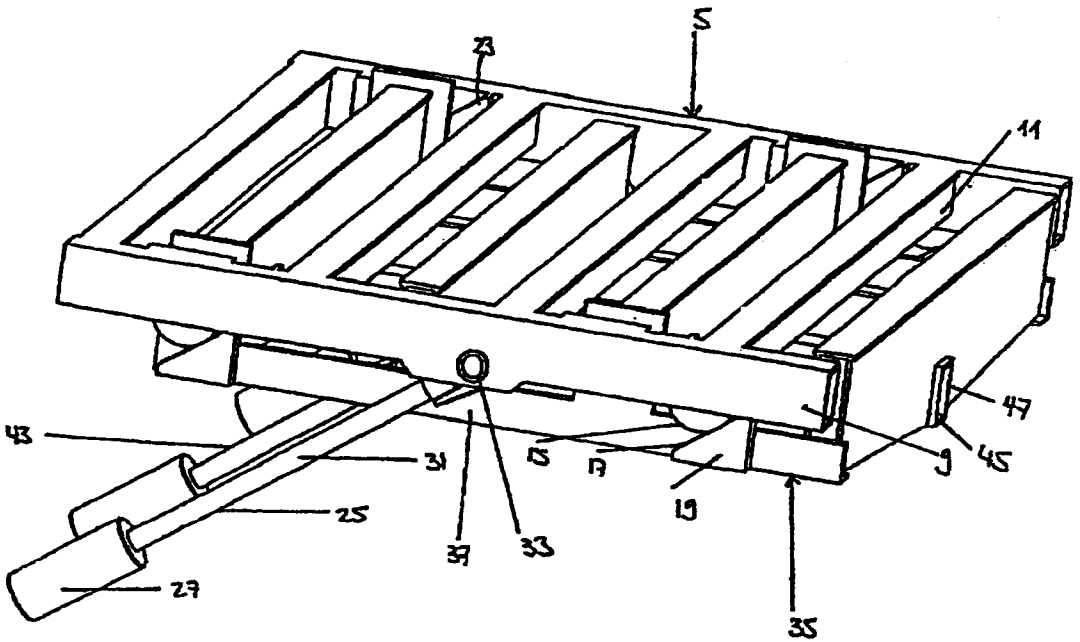
Figure 4:
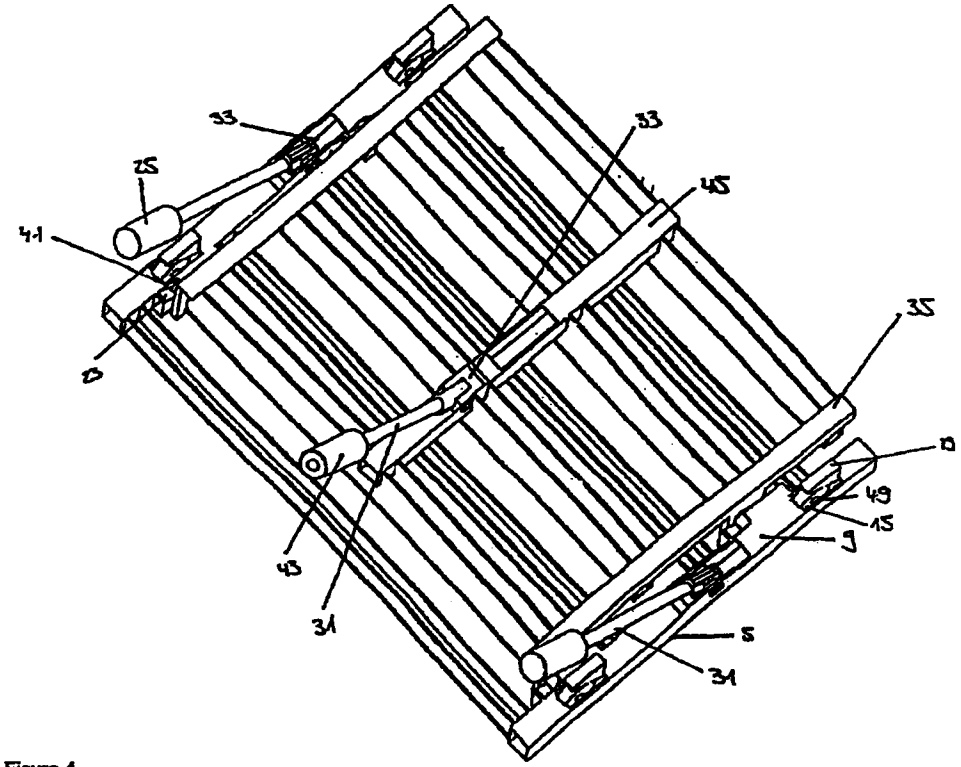
Figure 5:
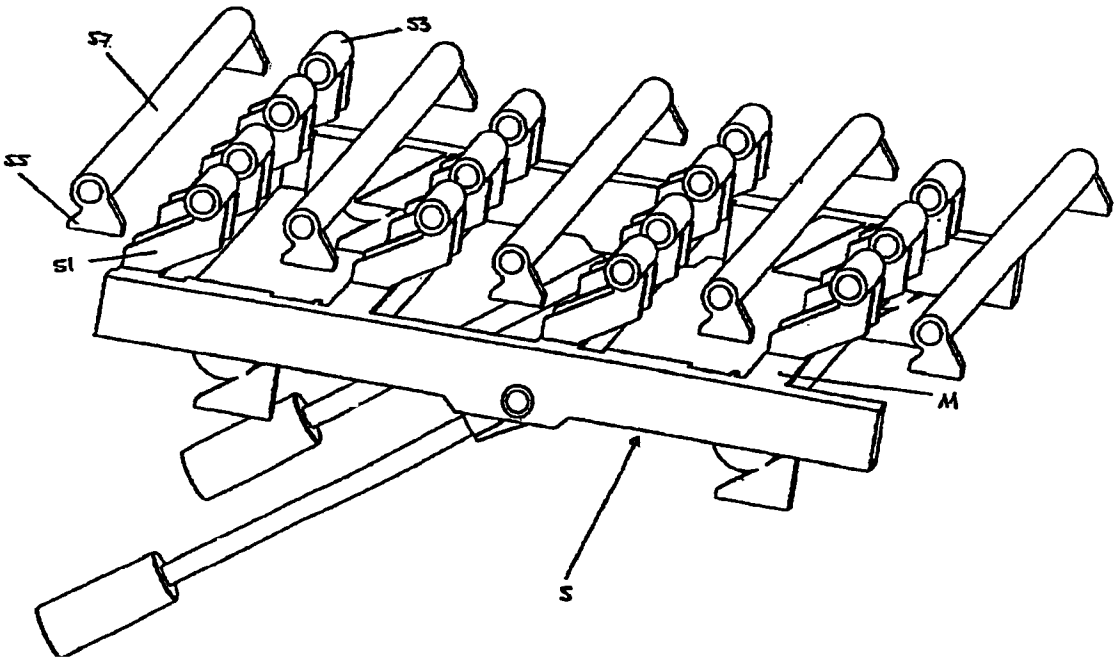
Figure 6:
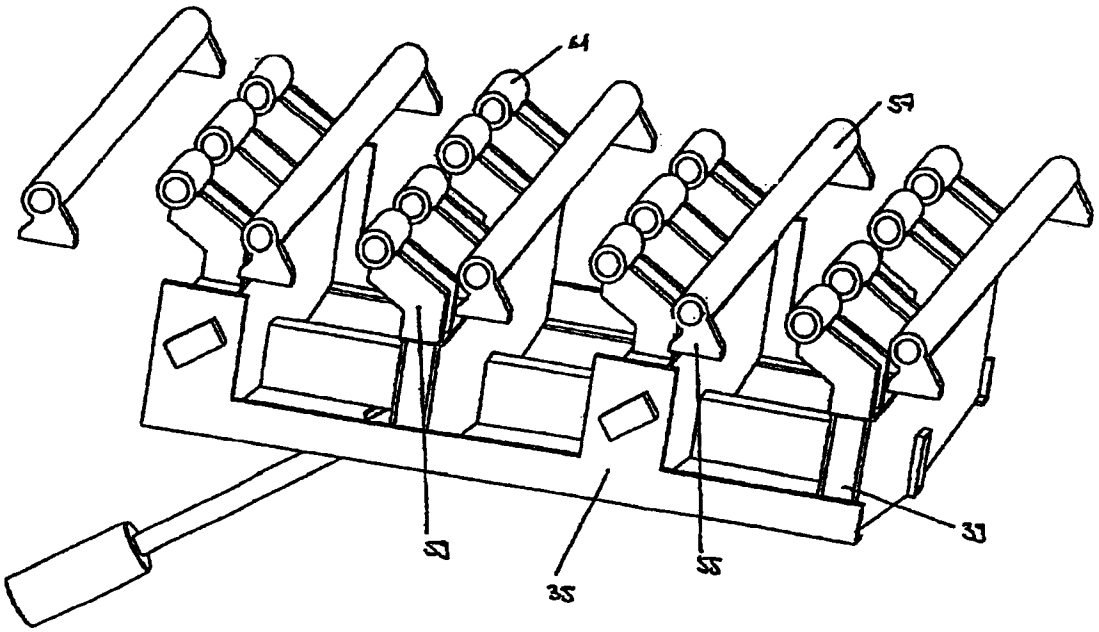
Figure 7:
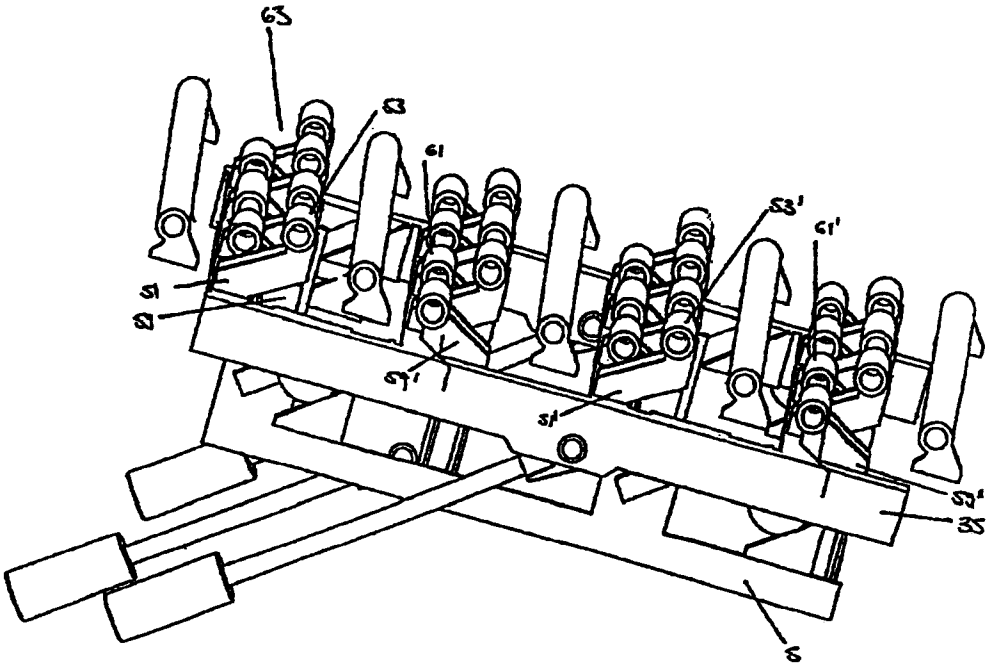
Figure 8:
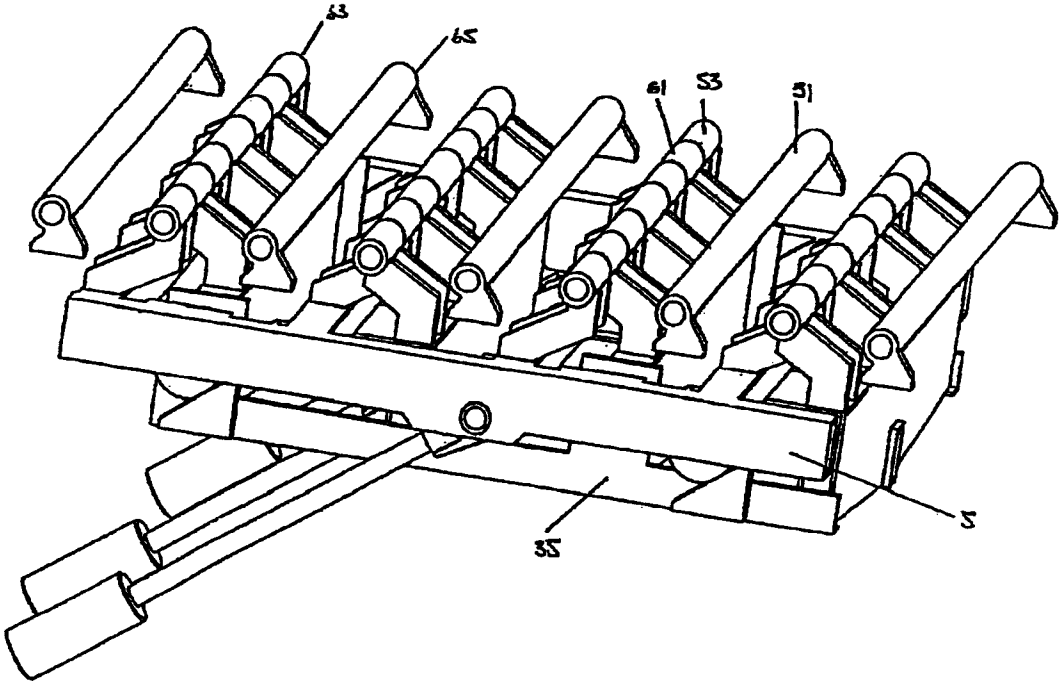
Figure 8:
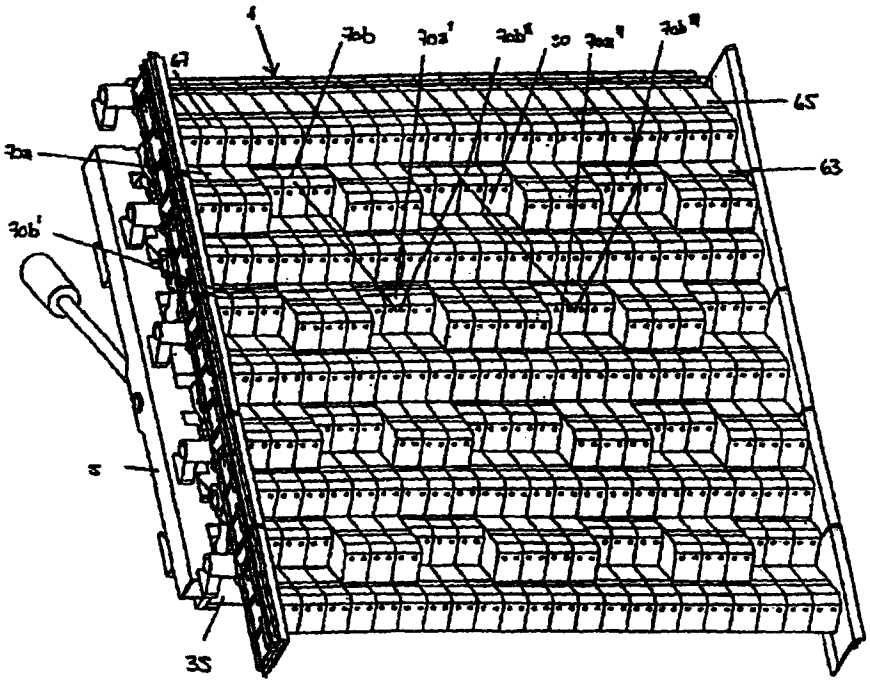
Figure 10:
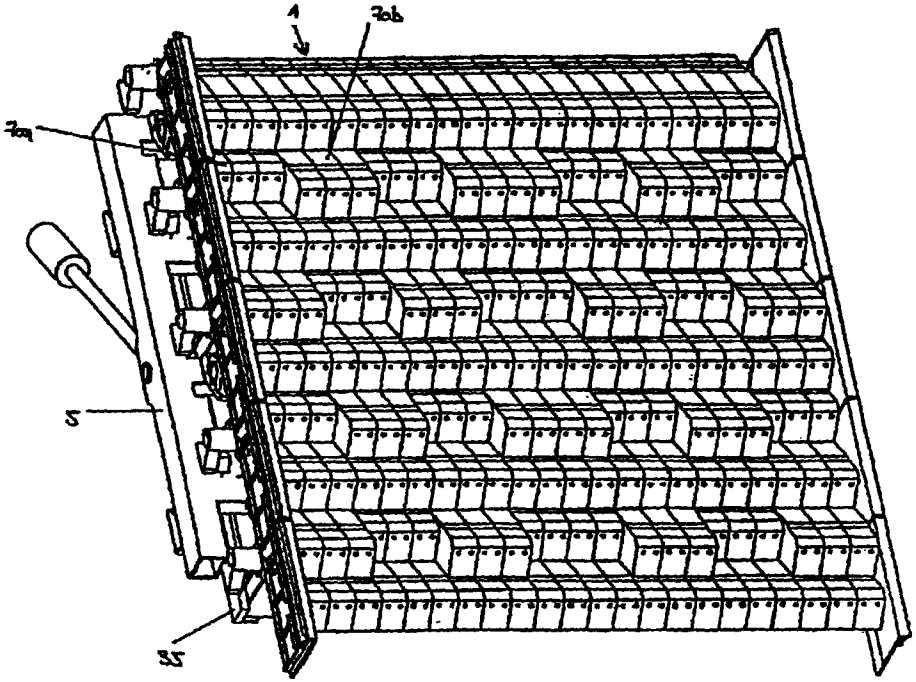
Figure 11:
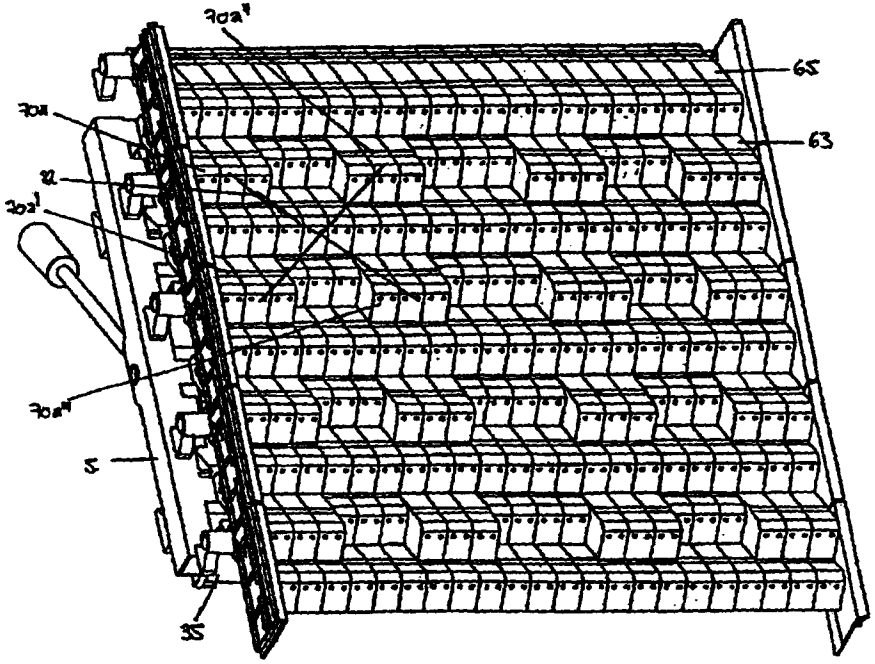
Figure 12:
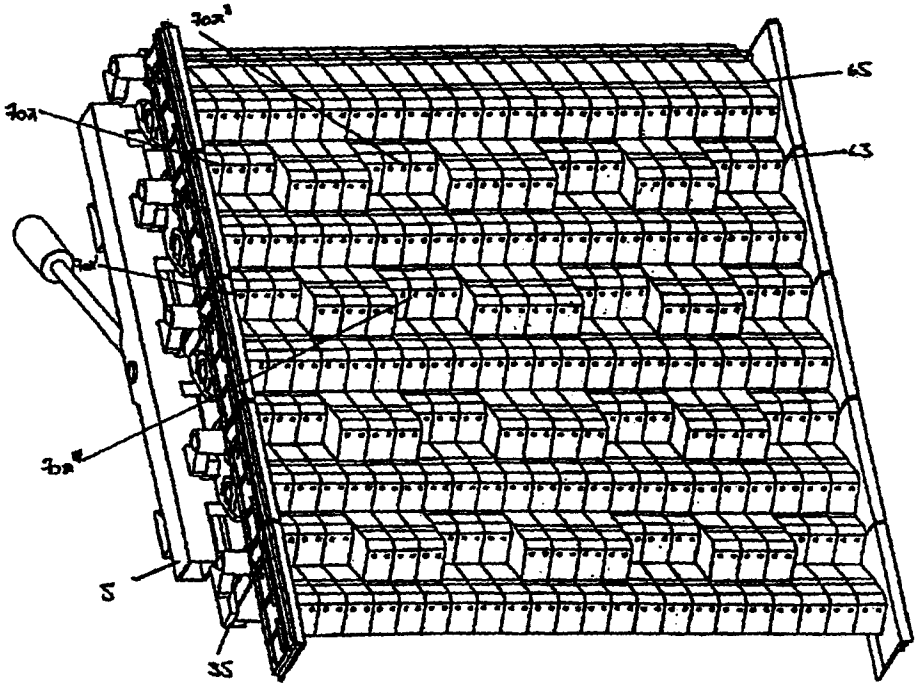
Figure 13:
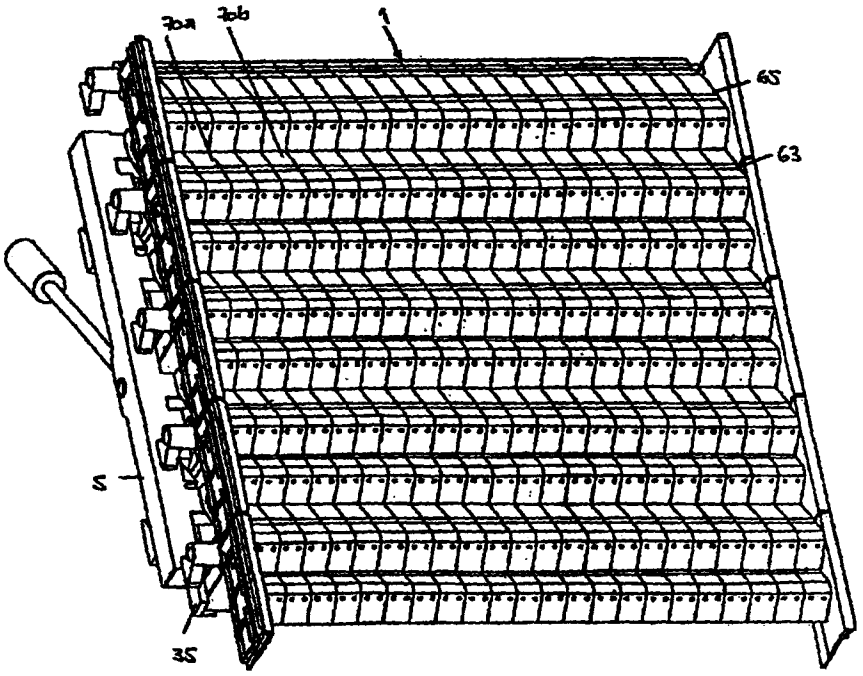
Figure 14:
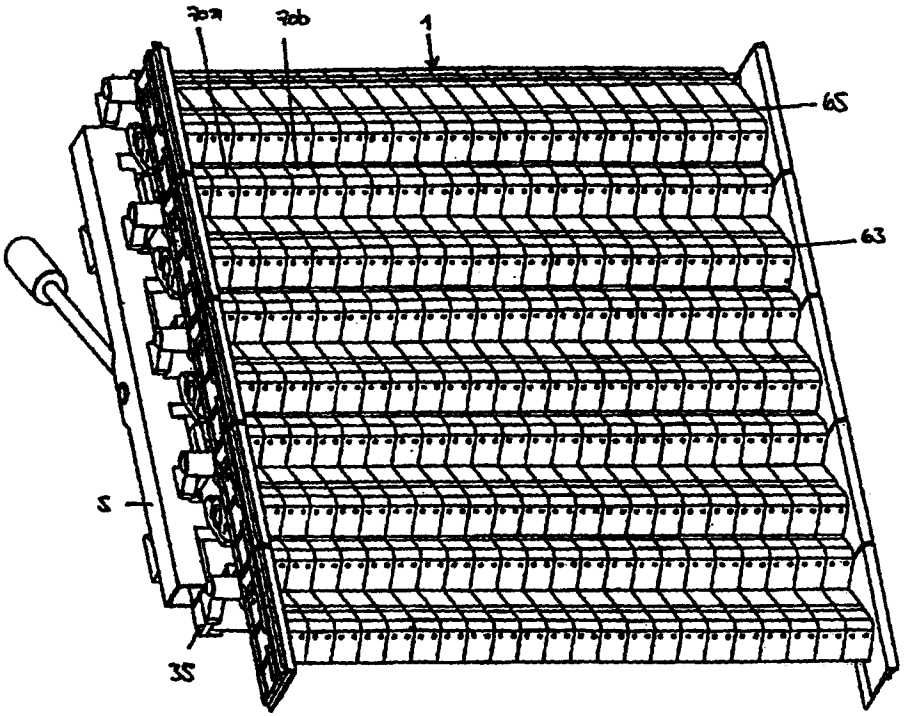

FIG. 6 shows the second grate carriage 35. Second brackets 59 are arranged on the second crossmembers 39. Second block-holding-tube portions 61 are arranged on the second s-shaped brackets 59. These tube portions are intended for bearing a second number of grate blocks of the moveable rows of grate blocks. The second brackets 59 are arranged on the second crossmembers 39 in a mirror-inverted manner in relation to the first brackets 51 on the first crossmembers 11. The second block-holding-tube portions 61 extend only over a part of the second crossmember 39. It is preferable for three to four second brackets 59 with block-holding-tube portions 61 to be arranged on a second crossmember 39. The stationary brackets 55 with the stationary block-holding tubes 57 arranged thereon are shown schematically between the second brackets 59 arranged on the second crossmembers 39.

Figure 7:
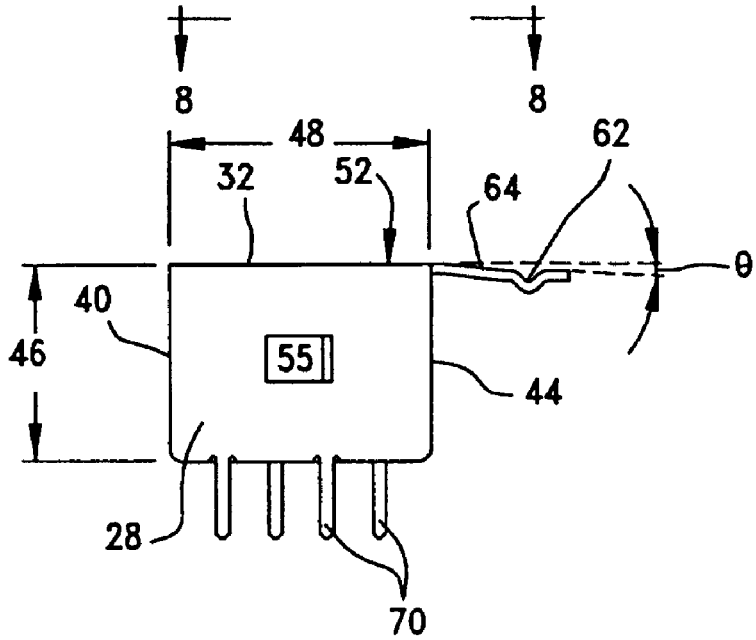
FIG. 7 shows the grate carriages shown in FIGS. 5 and 6, in an end position.

The first and second grate carriages 5, 35 shown in FIGS. 5 and 6 are shown in the assembled state in FIG. 7. The grate carriages 5, 35 are in an end position, i.e. the rollers 15 of the first grate carriage 5 are located at the end of the running surface 17. Within a moveable row of grate blocks 63, the first brackets 51 with the first block-holding-tube portions 53 alternate with the second brackets 59 with the second block-holding-tube portions 61. The brackets 51, 59', 51', 59" of the moveable grate blocks arranged in a line in the transporting direction are assigned in an alternating manner to the first or the second grate carriages 5, 35. However, it is also conceivable for the brackets of the moveable grate blocks arranged in a line in the transporting direction to be assigned to one grate carriage.

Figure 8:
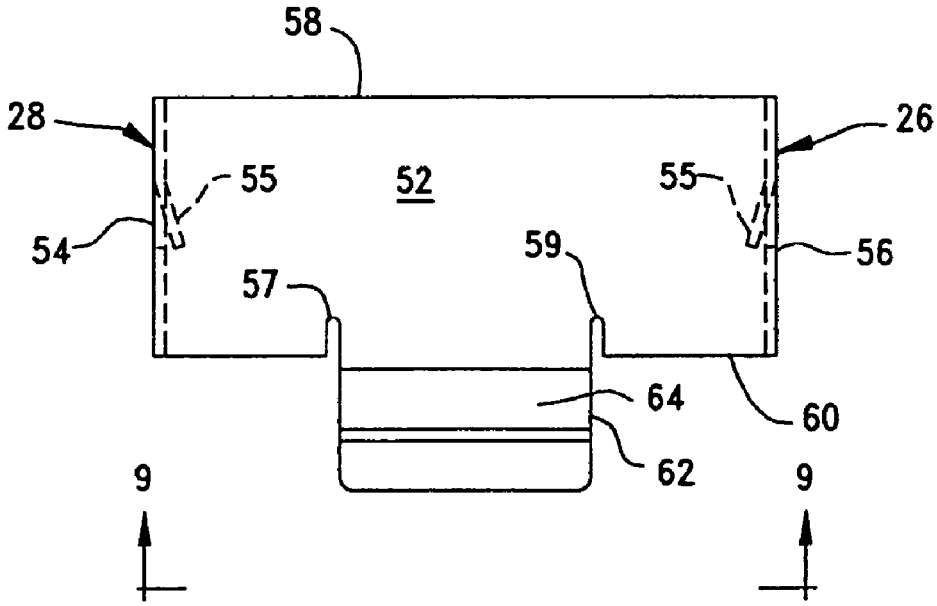
FIG. 8 shows the grate carriages shown in FIGS. 5 and 6, in a central position.

The embodiment shown in FIG. 7 is shown in a central position in FIG. 8, i.e the rollers 15 of the first grate carriage 5 are located on the center of the running surface 17. The axes of all the block-holding-tube portions 53, 61 of the movable rows 63 of grate blocks and the block-holding tubes 51 of the fixed rows 65 of grate blocks, in the position shown, are located in one plane.

Figure 9:
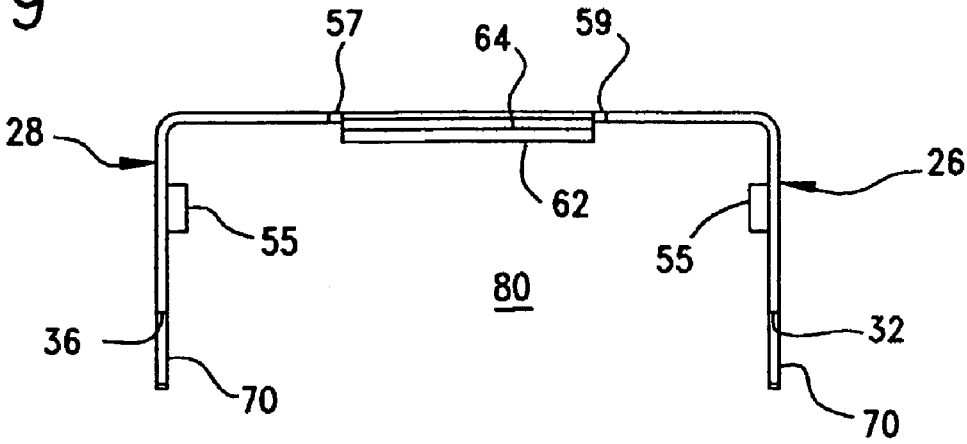
FIG. 9 shows a grate element with an W formation in the first end position.

FIG. 9 shows an embodiment of the grate element 1 according to the invention in a W position. In this case, fixed rows 65 of grate blocks are arranged in an alternating manner in relation to moveable rows 63 of grate blocks. In each case three or four grate blocks 67, which form a group 70 of grate blocks, are arranged on the first block-holding-tube portions 53 of the first grate carriage 5. The groups of grate blocks of the same row of grate blocks are assigned in an alternating manner to the first and the second grate carriages 5, 35. The forward and rearward movement of the first grate carriage and of the second grate carriage causes the group 70*a* of grate blocks to be displaced rearward and the group 70*b* of grate blocks to be displaced forward. As a result, the waste located on the surface of the group 70*a* of grate blocks is pushed away from the group 70*a* of grate blocks by the grate blocks 67*a* of the fixed row of grate blocks and is circulated laterally and in the transporting direction, which gives rise to optimum circulation. The group 70*b* of grate blocks, in contrast, is displaced forward and pushes away the waste on the surface of the fixed row of grate blocks. The groups 70*a*, 70*b'* of moveable grate blocks arranged in a line in the transporting direction are assigned in an alternating manner to the first grate carriage or the second grate carriage. If the groups 70*a*, 70*b'* of grate blocks are pushed forward, a very steep gradient is produced by way of the fixed row of grate blocks located therebetween, whereas the same groups of grate blocks have a shallow gradient if they are displaced rearward. The garbage is thus intermixed more or less randomly. In the end position, a so-called W position is formed since the rear groups 70*b*, 70*a'*, 70*b"*, 70*a"*, 70*b'"* of grate blocks of two moveable rows of grate blocks are in the shape of the letter W 80. Such an arrangement results in the waste which is to be incinerated being optimally intermixed, raked and conveyed.

Figure 10:
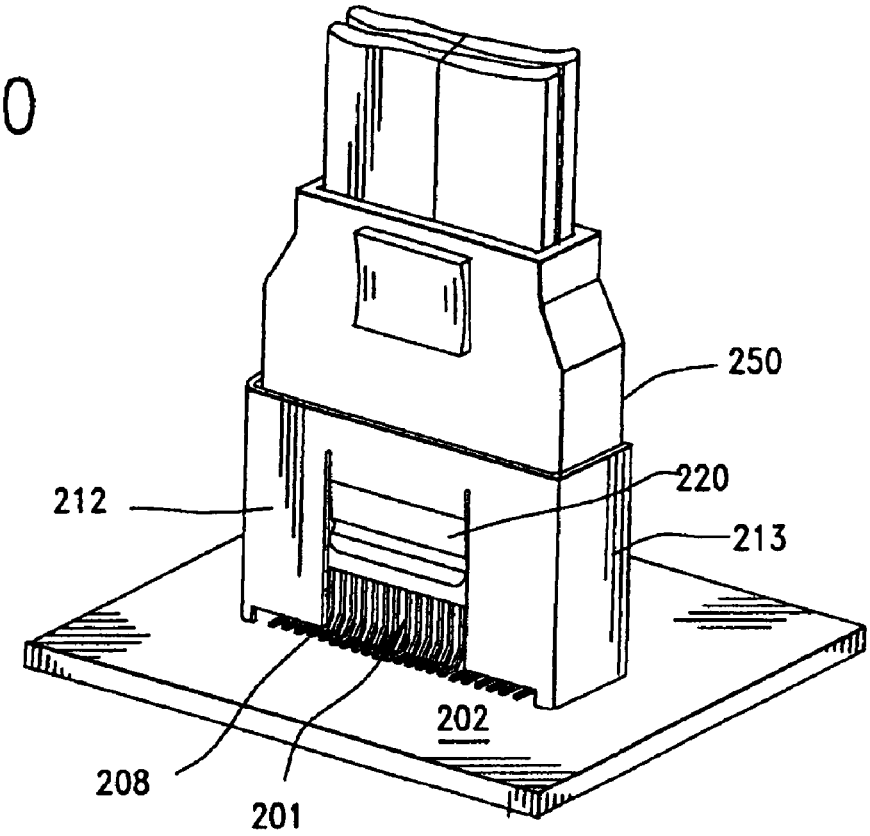
FIG. 10 shows a grate element with an W formation in the second end position.

That embodiment of the grate elements according to the invention which is shown in FIG. 9 is shown in the other end position in FIG. 10. In this case, those groups of grate blocks which are shown at the rear in FIG. 9 are now at the front, while those which are shown at the front are now arranged at the rear.

Figure 11:
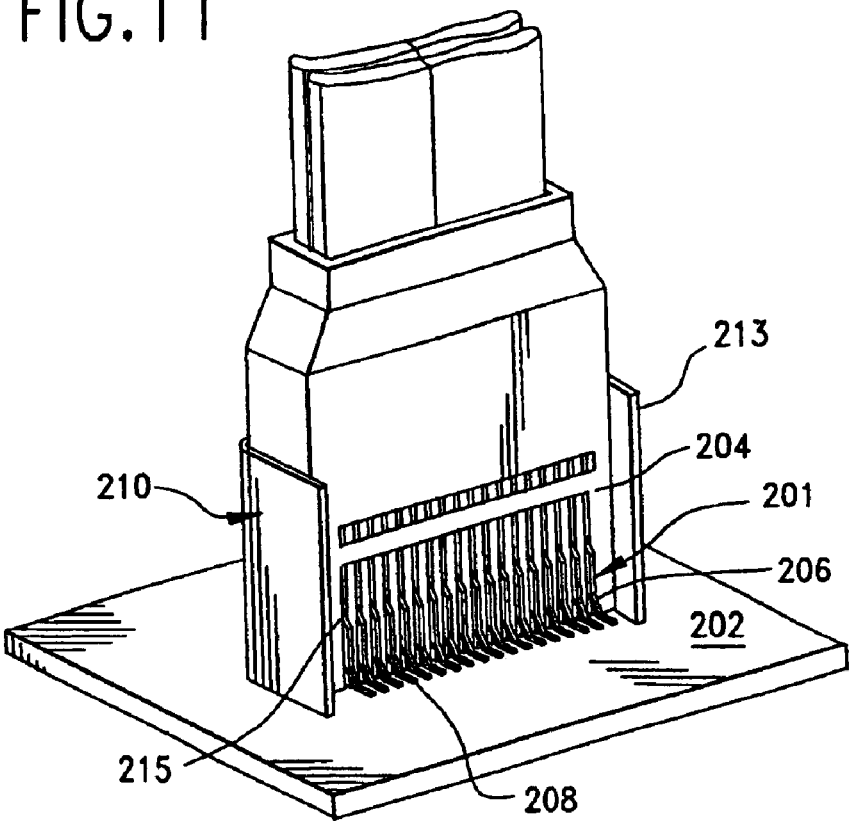
FIG. 11 shows a grate element with a X formation in the first end position.

FIG. 11 shows a further embodiment of the grate according to the invention in an X position. In this case, fixed rows 65 of grate blocks are arranged in an alternating manner in relation to moveable rows 63 of grate blocks. In each case three or four grate blocks 67, which form a group 70 of grate blocks, are arranged on the first block-holding-tube portions 53 of the first grate carriage 5. The groups 70*a*, 70*a'* of grate blocks of the same row of grate blocks are assigned in an alternating manner to the first grate carriage and the second grate carriage. The grate blocks of the moveable grate blocks arranged in a line in the transporting direction are assigned in each case to the first grate carriage or the second grate carriage. As a result, in the end position, an X position is formed since the front groups 70*a*, 70*a'"* and 70*a'*, 70*a"* of grate blocks of two moveable rows of grate blocks are in the shape of the letter X 82.

Figure 12:
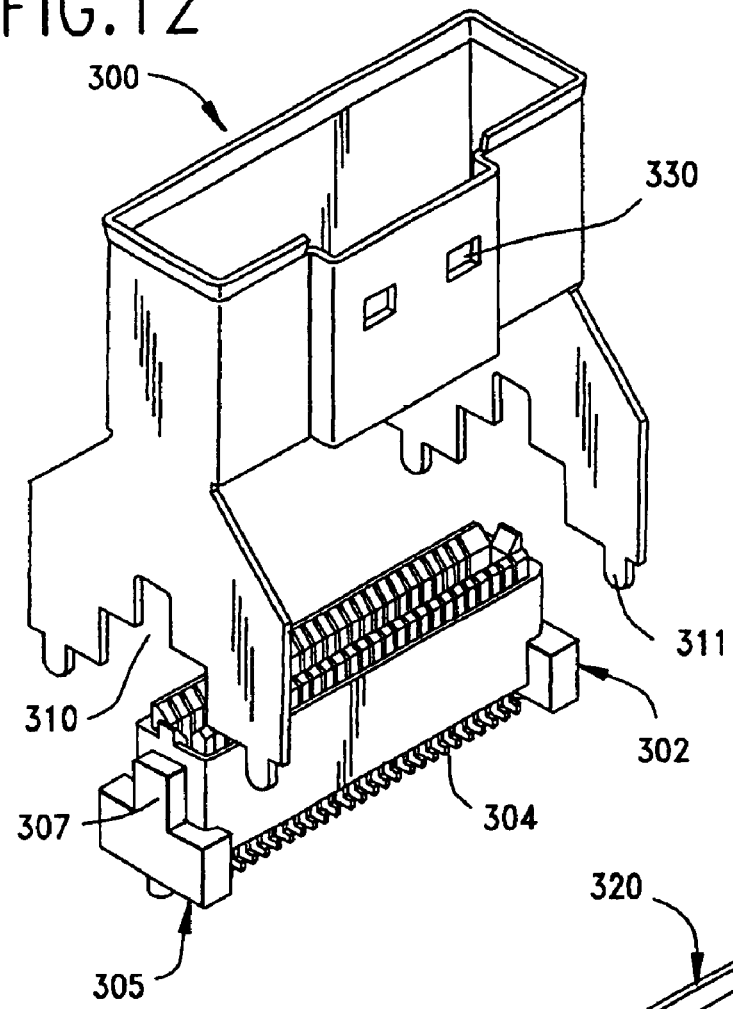
FIG. 12 shows a grate element with a X formation in the second end position.

That embodiment of the grate element 1 according to the invention which is shown in FIG. 11 is shown in the other end position in FIG. 12. In this case, those groups of grate blocks which are shown at the rear in FIG. 11 are now at the front, while those which are shown at the front are now arranged at the rear.

Figure 13:
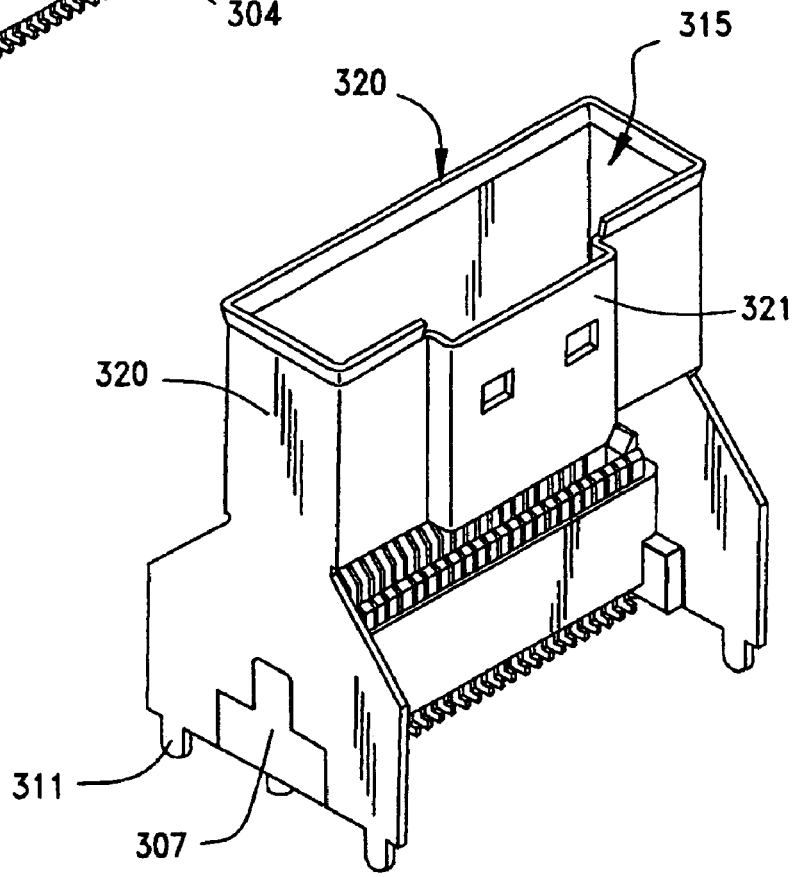
FIG. 13 shows a grate element with conventional grate-block guidance in the first end position.

FIG. 13 shows a further embodiment of the grate element 1 according to the invention, allowing operation as has been known up until now. In this case, fixed rows 65 of grate blocks are arranged in an alternating manner in relation to moveable rows 63 of grate blocks. In each case three or four grate blocks 67, which form a group 70 of grate blocks, are arranged on the first block-holding-tube portions 53 of the first grate carriage 5. The groups of grate blocks of the same row of grate blocks are assigned in an alternating manner to the first grate carriage and the second grate carriage. The first grate carriage and the second grate carriage move such that the grate blocks of the two grate carriages move in the same direction at the same point in time. This shows the extraordinary flexibility of the grate element 1 according to the invention, since allowance can be made, as desired, for the respective ambient conditions in each operating phase by corresponding activation of the cylinder/piston subassemblies.

Figure 14:
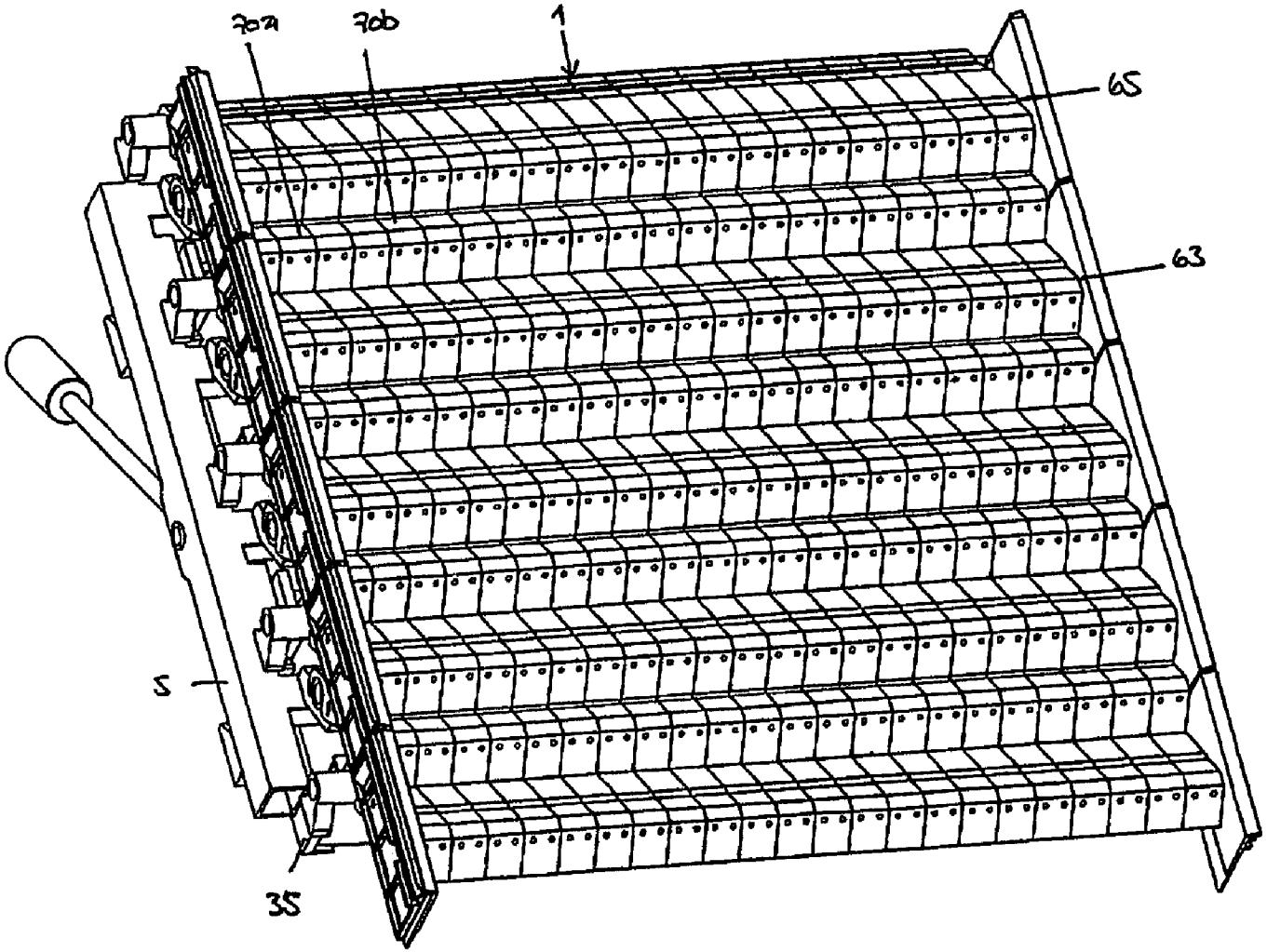
FIG. 14 shows a grate element with conventional grate-block guidance in the second end position.
Figure 1:
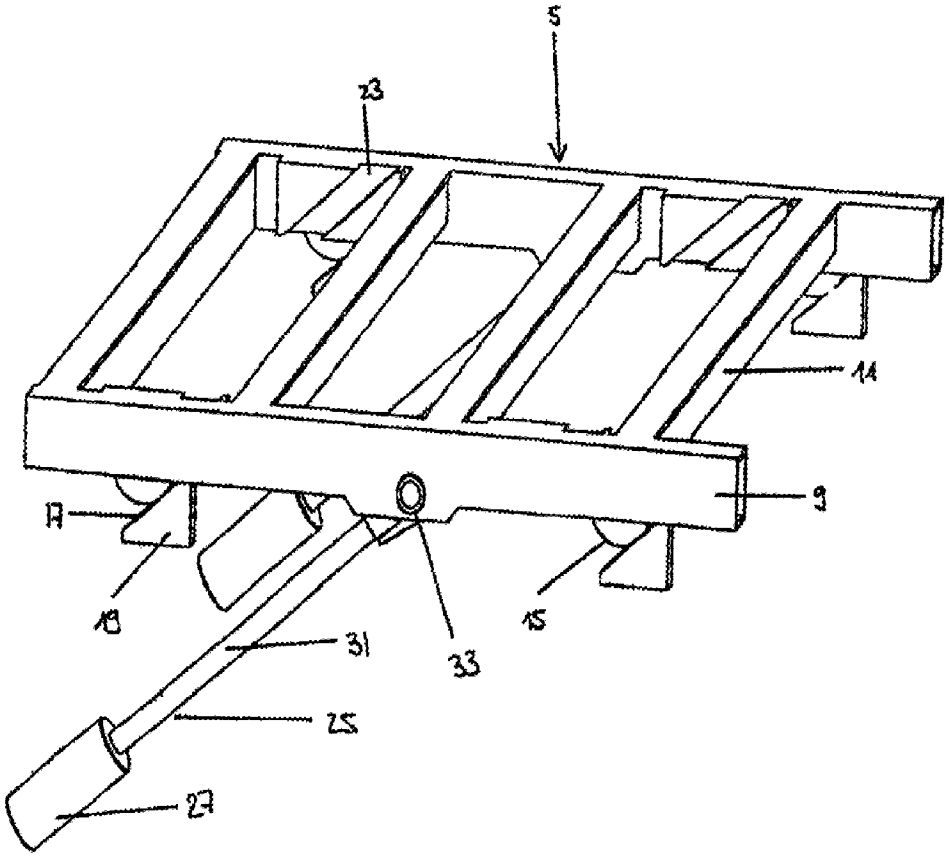
Figure 2:
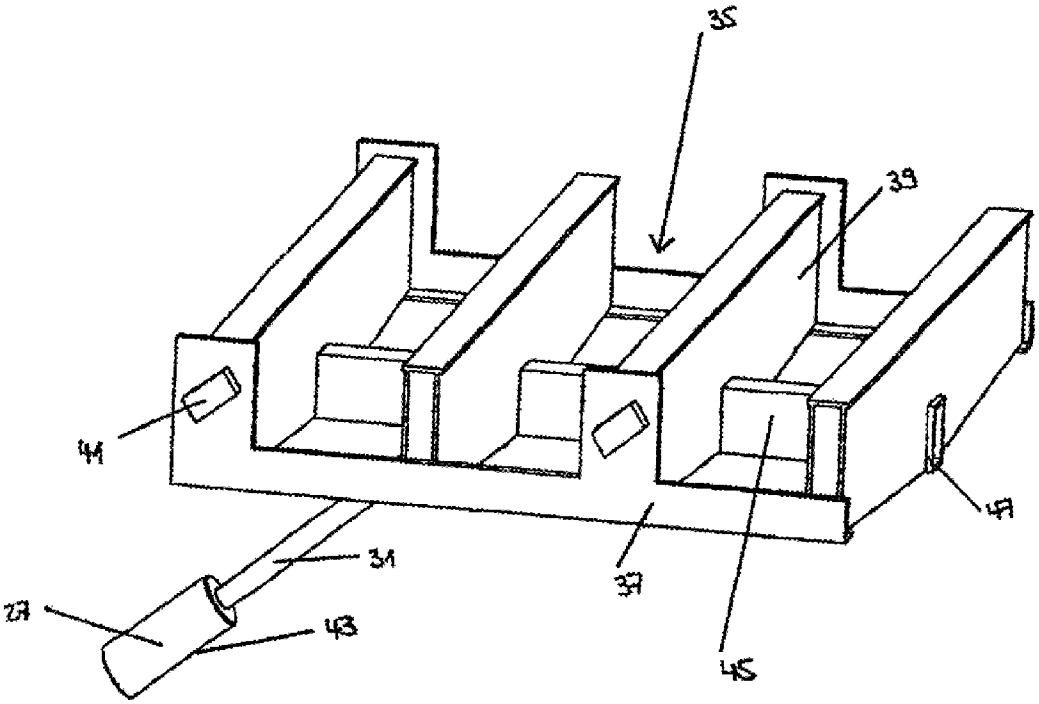
Figure 3:
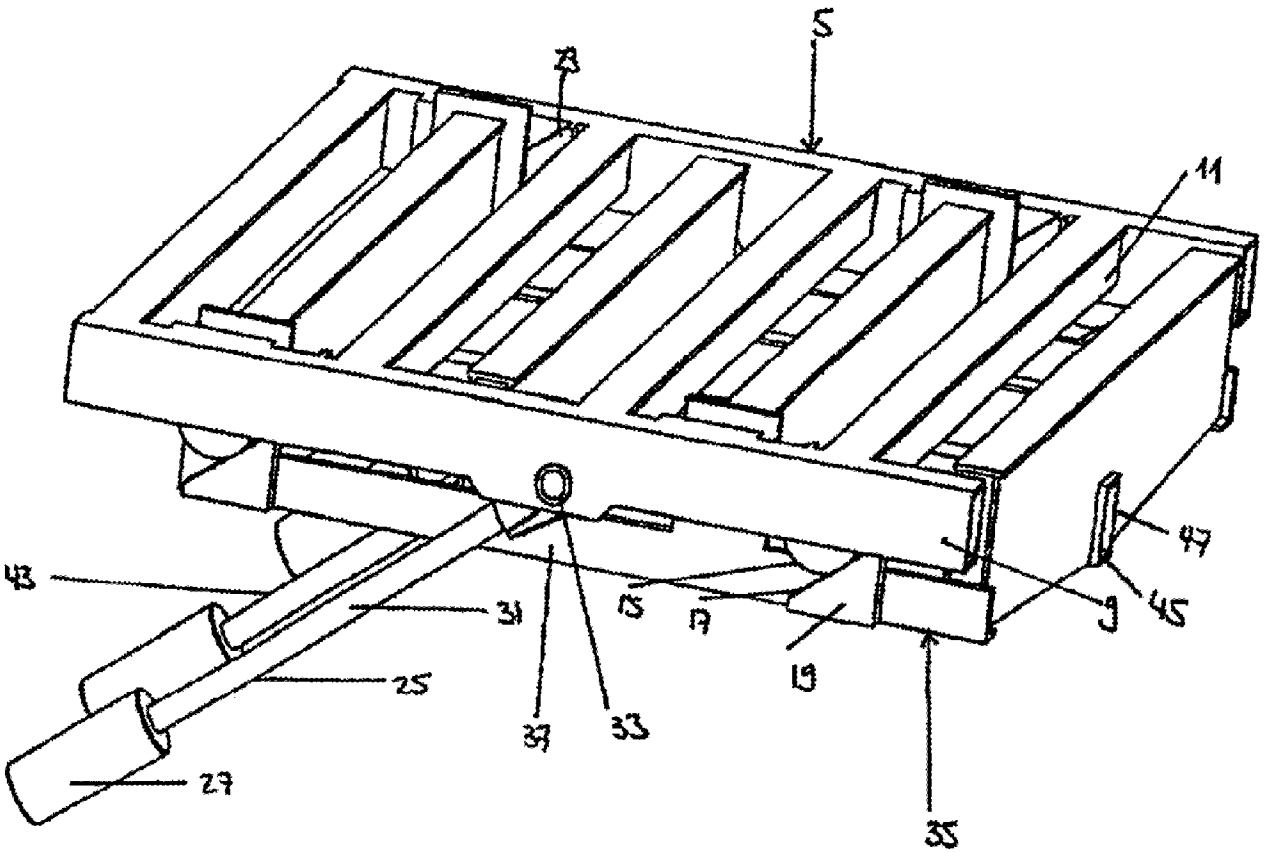

That embodiment of the grate element according to the invention which is shown in FIG. 13 is shown in the other end position in FIG. 14.

The invention claimed is:

1. A grate element for a grate of a waste-incineration plant, having a plurality of fixed or moveable rows of grate blocks arranged one behind the other, in each case one fixed row of grate blocks being followed by at least one moveable row of grate blocks, and a plurality of grate blocks being arranged in each row of grate blocks, wherein a first number of grate blocks arranged in a moveable row of grate blocks is assigned to a first grate carriage, and a second number of grate blocks arranged in the moveable row of grate blocks is assigned to a second grate carriage, it being possible for the first number of grate blocks to be moved independently of the second number of grate blocks, wherein the first grate carriage and the second grate carriage are moved cyclically in phase.

2. A grate element for a grate of a waste-incineration plant, having a plurality of fixed or moveable rows of grate blocks arranged one behind the other, in each case one fixed row of grate blocks being followed by at least one moveable row of grate blocks, and a plurality of grate blocks being arranged in each row of grate blocks, wherein a first number of grate blocks arranged in a moveable row of grate blocks is assigned to a first grate carriage, and a second number of grate blocks arranged in the moveable row of grate blocks is assigned to a second grate carriage, it being possible for the first number of grate blocks to be moved independently of the second number of grate blocks, wherein the moveable grate blocks arranged in a line in the transporting direction are assigned to the same grate carriage.

3. A grate carriage for a grate element for a grate of a waste-incineration plant, the grate element having a plurality of fixed or moveable rows of grate blocks arranged one behind the other, in each case one fixed row of grate blocks being followed by at least one moveable row of grate blocks, and a plurality of grate blocks being arranged in each row of grate blocks, wherein a first number of grate blocks arranged in a moveable row of grate blocks is assigned to a first grate carriage, and a second number of grate blocks arranged in the moveable row of grate blocks is assigned to a second grate carriage, it being possible for the first number of grate blocks to be moved independently of the second number of grate blocks, and the grate carriage having crossmembers which are intended for bearing a plurality of block-holding-tube portions for a moveable row of grate blocks, the block-holding-tube portions of the moveable grate blocks extending only over part of the grate-carriage width.

* * * * *

UNITED STATES PATENT AND TRADEMARK OFFICE

CERTIFICATE OF CORRECTION

PATENT NO. : 7,424,856 B2
APPLICATION NO. : 10/525565
DATED : September 16, 2008
INVENTOR(S) : Werner Brennwald et al.

It is certified that error appears in the above-identified patent and that said Letters Patent is hereby corrected as shown below:

The title page should be deleted to appear as per attached title page.

The sheets of drawings consisting of figures 1-13 should be deleted to appear as per attached figures 1-13.

Signed and Sealed this

Twenty-fifth Day of November, 2008

JON W. DUDAS
*Director of the United States Patent and Trademark Office*

(12) United States Patent
Brennwald et al.

(10) Patent No.: US 7,424,856 B2
(45) Date of Patent: Sep. 16, 2008

(54) GRATE ELEMENT FOR A GRATE OF A WASTE COMBUSTION INSTALLATION

(75) Inventors: Werner Brennwald, Neftenbach (CH); Manfred Wider, Uster (CH); Fritz Weber, Netstal (CH)

(73) Assignee: Von Roll Umwelttechnik AG (CH)

( * ) Notice: Subject to any disclaimer, the term of this patent is extended or adjusted under 35 U.S.C. 154(b) by 397 days.

(21) Appl. No.: 10/525,565

(22) PCT Filed: Aug. 22, 2003

(86) PCT No.: PCT/EP03/09323

§ 371 (c)(1),
(2), (4) Date: Feb. 25, 2005

(87) PCT Pub. No.: WO2004/025181

PCT Pub. Date: Mar. 25, 2004

(65) Prior Publication Data

US 2005/0257723 A1 Nov. 24, 2005

(30) Foreign Application Priority Data

Aug. 29, 2002 (EP) ..... 02405738

(51) Int. Cl.
*F23H 7/08* (2006.01)

(52) U.S. Cl. ..... 110/281; 110/258; 110/291

(58) Field of Classification Search ..... 110/281, 110/257, 258, 267, 268, 282, 283, 284, 289, 110/290, 291, 296

See application file for complete search history.

(56) References Cited

U.S. PATENT DOCUMENTS

| | | | | |
|---|---|---|---|---|
| 4,170,183 | A | 10/1979 | Cross | |
| 4,901,653 | A * | 2/1990 | Baltzinger | 110/283 |
| 5,197,397 | A | 3/1993 | Yamagishi et al. | |

FOREIGN PATENT DOCUMENTS

| | | |
|---|---|---|
| CH | 585 372 | 2/1977 |
| DE | 525 221 | 5/1931 |
| DE | 1 099 117 | 2/1961 |
| EP | 1 001 218 B1 | 5/2000 |
| FR | 2 265 041 | 10/1975 |

OTHER PUBLICATIONS

Max Künzli, W + E-Gegenlauf Überschubrost, p. 1-17.

* cited by examiner

*Primary Examiner*—Kenneth B Rinehart
(74) *Attorney, Agent, or Firm*—Hershkovitz & Associates, LLC; Abe Hershkovitz

(57) ABSTRACT

The present invention relates to a grate element (1) for a grate of a waste-incineration plant, having a plurality of rows of grate blocks, which are moveable or fixed, arranged one behind the other, a plurality of grate blocks (67) being arranged in each row of grate blocks. A first number of grate blocks arranged in a moveable row of grate blocks here is assigned to a first grate carriage (5), and a second number of grate blocks arranged in a moveable row of grate blocks is assigned to a second grate carriage (35), it being possible for the first number of grate blocks to be moved independently of the second number of grate blocks.

3 Claims, 7 Drawing Sheets

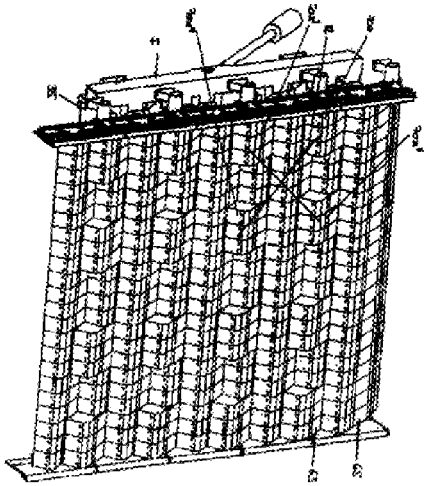

UNITED STATES PATENT AND TRADEMARK OFFICE

CERTIFICATE OF CORRECTION

PATENT NO. : 7,424,856 B2
APPLICATION NO. : 10/525565
DATED : September 16, 2008
INVENTOR(S) : Werner Brennwald et al.

It is certified that error appears in the above-identified patent and that said Letters Patent is hereby corrected as shown below:

The title page should be deleted to appear as per attached title page.

The sheets of drawings consisting of figures 1-13 should be deleted to appear as per attached figures 1-13.

This certificate supersedes the Certificate of Correction issued November 25, 2008.

Signed and Sealed this

Twenty-third Day of December, 2008

JON W. DUDAS
*Director of the United States Patent and Trademark Office*

(12) United States Patent
Brennwald et al.

(10) Patent No.: US 7,424,856 B2
(45) Date of Patent: Sep. 16, 2008

(54) GRATE ELEMENT FOR A GRATE OF A WASTE COMBUSTION INSTALLATION

(75) Inventors: Werner Brennwald, Neftenbach (CH); Manfred Wider, Uster (CH); Fritz Weber, Netstal (CH)

(73) Assignee: Von Roll Umwelttechnik AG (CH)

( * ) Notice: Subject to any disclaimer, the term of this patent is extended or adjusted under 35 U.S.C. 154(b) by 397 days.

(21) Appl. No.: 10/525,565

(22) PCT Filed: Aug. 22, 2003

(86) PCT No.: PCT/EP03/09323

§ 371 (c)(1),
(2), (4) Date: Feb. 25, 2005

(87) PCT Pub. No.: WO2004/025181

PCT Pub. Date: Mar. 25, 2004

(65) Prior Publication Data

US 2005/0257723 A1 Nov. 24, 2005

(30) Foreign Application Priority Data

Aug. 29, 2002 (EP) ..... 02405738

(51) Int. Cl.
*F23H 7/08* (2006.01)

(52) U.S. Cl. ..... 110/281; 110/258; 110/291

(58) Field of Classification Search ..... 110/281, 110/257, 258, 267, 268, 282, 283, 284, 289, 110/290, 291, 296

See application file for complete search history.

(56) References Cited

U.S. PATENT DOCUMENTS

| | | | | |
|---|---|---|---|---|
| 4,170,183 | A | 10/1979 | Cross | |
| 4,901,653 | A * | 2/1990 | Baltzinger | 110/283 |
| 5,197,397 | A | 3/1993 | Yamagishi et al. | |

FOREIGN PATENT DOCUMENTS

| | | |
|---|---|---|
| CH | 585 372 | 2/1977 |
| DE | 525 221 | 5/1931 |
| DE | 1 099 117 | 2/1961 |
| EP | 1 001 218 B1 | 5/2000 |
| FR | 2 265 041 | 10/1975 |

OTHER PUBLICATIONS

Max Künzli, W + E-Gegenlauf Überschubrost, p. 1-17.

* cited by examiner

*Primary Examiner*—Kenneth B Rinehart
(74) *Attorney, Agent, or Firm*—Hershkovitz & Associates, LLC; Abe Hershkovitz

(57) ABSTRACT

The present invention relates to a grate element (1) for a grate of a waste-incineration plant, having a plurality of rows of grate blocks, which are moveable or fixed, arranged one behind the other, a plurality of grate blocks (67) being arranged in each row of grate blocks. A first number of grate blocks arranged in a moveable row of grate blocks here is assigned to a first grate carriage (5), and a second number of grate blocks arranged in a moveable row of grate blocks is assigned to a second grate carriage (35), it being possible for the first number of grate blocks to be moved independently of the second number of grate blocks.

3 Claims, 7 Drawing Sheets

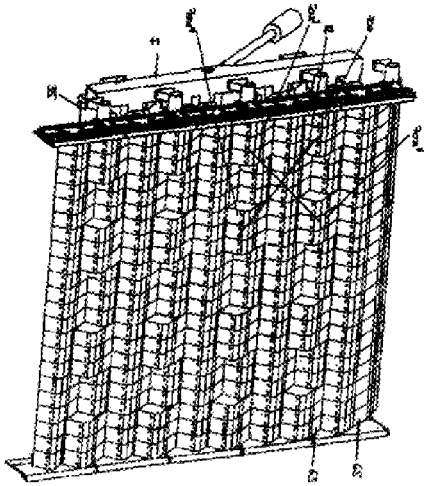

UNITED STATES PATENT AND TRADEMARK OFFICE

CERTIFICATE OF CORRECTION

PATENT NO. : 7,424,856 B2
APPLICATION NO. : 10/525565
DATED : September 16, 2008
INVENTOR(S) : Werner Brennwald et al.

It is certified that error appears in the above-identified patent and that said Letters Patent is hereby corrected as shown below:

The title page should be deleted to appear as per attached title page.

The sheets of drawings consisting of figures 1-13 should be deleted to appear as per attached figures 1-13.

This certificate supersedes the Certificates of Correction issued November 25, 2008 and December 23, 2008.

Signed and Sealed this

Tenth Day of February, 2009

JOHN DOLL
*Acting Director of the United States Patent and Trademark Office*

(12) United States Patent
Brennwald et al.

(10) Patent No.: US 7,424,856 B2
(45) Date of Patent: Sep. 16, 2008

(54) GRATE ELEMENT FOR A GRATE OF A WASTE COMBUSTION INSTALLATION

(75) Inventors: Werner Brennwald, Neftenbach (CH); Manfred Wider, Uster (CH); Fritz Weber, Neustal (CH)

(73) Assignee: Von Roll Umwelttechnik AG (CH)

( * ) Notice: Subject to any disclaimer, the term of this patent is extended or adjusted under 35 U.S.C. 154(b) by 397 days.

(21) Appl. No.: 10/525,565

(22) PCT Filed: Aug. 22, 2003

(86) PCT No.: PCT/EP03/09323

§ 371 (c)(1),
(2), (4) Date: Feb. 25, 2005

(87) PCT Pub. No.: WO2004/025181

PCT Pub. Date: Mar. 25, 2004

(65) Prior Publication Data

US 2005/0257723 A1 Nov. 24, 2005

(30) Foreign Application Priority Data

Aug. 29, 2002 (EP) ..... 02405738

(51) Int. Cl.
*F23H 7/08* (2006.01)

(52) U.S. Cl. ..... 110/281; 110/258; 110/291

(58) Field of Classification Search ..... 110/281, 110/257, 258, 267, 268, 282, 283, 284, 289, 110/290, 291, 296

See application file for complete search history.

(56) References Cited

U.S. PATENT DOCUMENTS

| | | | | |
|---|---|---|---|---|
| 4,170,183 | A | 10/1979 | Cross | |
| 4,901,653 | A * | 2/1990 | Baltzinger | 110/281 |
| 5,197,397 | A | 3/1993 | Yamagishi et al. | |

FOREIGN PATENT DOCUMENTS

| | | |
|---|---|---|
| CH | 585 372 | 2/1977 |
| DE | 525 221 | 5/1931 |
| DE | 1 099 117 | 2/1961 |
| EP | 1 001 218 B1 | 5/2000 |
| FR | 2 265 041 | 10/1975 |

OTHER PUBLICATIONS

Max Künzli, W + E-Gegenlauf Überschubrost, p. 1-17.

* cited by examiner

*Primary Examiner*—Kenneth B Rinehart
(74) *Attorney, Agent, or Firm*—Hershkovitz & Associates, LLC; Abe Hershkovitz

(57) ABSTRACT

The present invention relates to a grate element (1) for a grate of a waste-incineration plant, having a plurality of rows of grate blocks, which are moveable or fixed, arranged one behind the other, a plurality of grate blocks (67) being arranged in each row of grate blocks. A first number of grate blocks arranged in a moveable row of grate blocks here is assigned to a first grate carriage (5), and a second number of grate blocks arranged in a moveable row of grate blocks is assigned to a second grate carriage (35), it being possible for the first number of grate blocks to be moved independently of the second number of grate blocks.

3 Claims, 13 Drawing Sheets

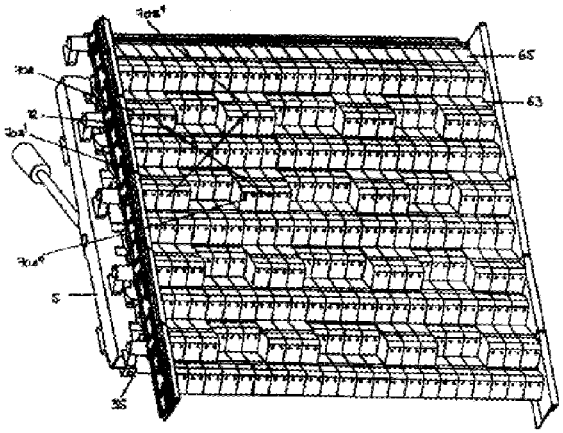

UNITED STATES PATENT AND TRADEMARK OFFICE

CERTIFICATE OF CORRECTION

PATENT NO. : 7,424,856 B2
APPLICATION NO. : 10/525565
DATED : September 16, 2008
INVENTOR(S) : Werner Brennwald et al.

It is certified that error appears in the above-identified patent and that said Letters Patent is hereby corrected as shown below:

The title page should be deleted to appear as per attached title page.

Delete the Drawing Sheets 1-7 and substitute therefor the attached Drawing Sheets 1-14.

This certificate supersedes all previously issued Certificates of Correction.

Signed and Sealed this

Fifteenth Day of June, 2010

David J. Kappos

David J. Kappos
*Director of the United States Patent and Trademark Office*

(12) United States Patent
Brennwald et al.

(10) Patent No.: US 7,424,856 B2
(45) Date of Patent: Sep. 16, 2008

(54) GRATE ELEMENT FOR A GRATE OF A WASTE COMBUSTION INSTALLATION

(75) Inventors: Werner Brennwald, Neftenbach (CH); Manfred Wider, Uster (CH); Fritz Weber, Netstal (CH)

(73) Assignee: Von Roll Umwelttechnik AG (CH)

( * ) Notice: Subject to any disclaimer, the term of this patent is extended or adjusted under 35 U.S.C. 154(b) by 397 days.

(21) Appl. No.: 10/525,565

(22) PCT Filed: Aug. 22, 2003

(86) PCT No.: PCT/EP03/09323

§ 371 (c)(1),
(2), (4) Date: Feb. 25, 2005

(87) PCT Pub. No.: WO2004/025181

PCT Pub. Date: Mar. 25, 2004

(65) Prior Publication Data

US 2005/0257723 A1 Nov. 24, 2005

(30) Foreign Application Priority Data

Aug. 29, 2002 (EP) ..... 02405738

(51) Int. Cl.
*F23H 7/08* (2006.01)

(52) U.S. Cl. ..... 110/281; 110/258; 110/291

(58) Field of Classification Search ..... 110/281
110/257, 258, 267, 268, 282, 283, 284, 289, 110/290, 291, 296
See application file for complete search history.

(56) References Cited

U.S. PATENT DOCUMENTS

| | | | | |
|---|---|---|---|---|
| 4,170,183 | A | 10/1979 | Cross | |
| 4,901,653 | A * | 2/1990 | Baltzinger | 110/281 |
| 5,197,397 | A | 3/1993 | Yamagishi et al. | |

FOREIGN PATENT DOCUMENTS

| | | |
|---|---|---|
| CH | 585 372 | 2/1977 |
| DE | 525 221 | 5/1931 |
| DE | 1 099 117 | 2/1961 |
| EP | 1 001 218 B1 | 5/2000 |
| FR | 2 265 041 | 10/1975 |

OTHER PUBLICATIONS

Max Künzli, W + E-Gegenlauf Überschubrost, p. 1-17.

* cited by examiner

*Primary Examiner*—Kenneth B Rinehart
(74) *Attorney, Agent, or Firm*—Hershkovitz & Associates, LLC; Abe Hershkovitz

(57) ABSTRACT

The present invention relates to a grate element (1) for a grate of a waste-incineration plant, having a plurality of rows of grate blocks, which are moveable or fixed, arranged one behind the other, a plurality of grate blocks (67) being arranged in each row of grate blocks. A first number of grate blocks arranged in a moveable row of grate blocks here is assigned to a first grate carriage (5), and a second number of grate blocks arranged in a moveable row of grate blocks is assigned to a second grate carriage (35), it being possible for the first number of grate blocks to be moved independently of the second number of grate blocks.

3 Claims, 14 Drawing Sheets